US010089832B2

(12) United States Patent
Takahashi et al.

(10) Patent No.: US 10,089,832 B2
(45) Date of Patent: Oct. 2, 2018

(54) GAME DEVICE, GAME CONTROL METHOD, AND STORAGE MEDIUM STORING A PROGRAM

(71) Applicant: Konami Digital Entertainment Orange County Development Studio, Inc., Santa Ana, CA (US)

(72) Inventors: Kazuya Takahashi, Torrance, CA (US); John Kirkland, Irvine, CA (US); Andrew Klinzing, Irvine, CA (US)

(73) Assignee: Konami Digital Entertainment Co., Ltd., Minato-ku, Tokyo (JP)

( * ) Notice: Subject to any disclaimer, the term of this patent is extended or adjusted under 35 U.S.C. 154(b) by 850 days.

(21) Appl. No.: 14/090,902

(22) Filed: Nov. 26, 2013

(65) Prior Publication Data

US 2014/0295938 A1 Oct. 2, 2014

Related U.S. Application Data

(60) Provisional application No. 61/806,193, filed on Mar. 28, 2013.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
None
See application file for complete search history.

(56) References Cited

U.S. PATENT DOCUMENTS

2006/0121978 A1* 6/2006 Hornik ..... G07F 17/32 463/20
2010/0120495 A1* 5/2010 Frank ..... G07F 17/3211 463/20
2014/0087820 A1* 3/2014 Brune ..... G07F 17/3262 463/20

(Continued)

FOREIGN PATENT DOCUMENTS

JP 2012-81316 A 4/2012

OTHER PUBLICATIONS

YouTube. (Uploaded on Jul. 10, 2011). Battle Slots PC Gameplay. [Video file]. Retrieved from <URL:https://www.youtube.com/watch?v=cuS8PwNAjFE> (Note: certain screen shots are attached).*

*Primary Examiner* — Robert T Clarke, Jr.
(74) *Attorney, Agent, or Firm* — Sughrue Mion, PLLC

(57) ABSTRACT

A game device includes a lottery unit to decide stop positions of spinning slot reels of a first reel group displayed on a display and select a type of battle action among plural types of battle action, with reference to the stop positions. The device includes a decision unit configured to decide the selected type of battle action as a battle action by a player character. Each type of battle action has an attribution associated with a set of symbols of the slot reels at the stop positions. The plural types of battle action include a first type of battle action having a first attribution to attack an enemy character and a second type of battle action having a second attribution different from the first attribution. The device includes a determination unit configured to decrease hit points of the enemy character and the player character.

15 Claims, 15 Drawing Sheets

(56) References Cited

U.S. PATENT DOCUMENTS

| | | | | |
|---|---|---|---|---|
| 2014/0094269 | A1* | 4/2014 | Cuddy | G07F 17/3267 463/21 |
| 2014/0256403 | A1* | 9/2014 | Caputo | G07F 17/3267 463/20 |

* cited by examiner

FIG. 11

| | |
|---|---|
| | ATTACK (VERY HEAVY DAMAGE) |
| | ATTACK (HEAVY DAMAGE) |
| | ATTACK (MEDIUM DAMAGE) |
| | MAGICAL ATTACK (VERY HEAVY DAMAGE) |
| | MAGICAL ATTACK (HEAVY DAMAGE) |
| | INCREASE IN DEFENSIVE STRENGTH (LARGE EFFECT) |
| | INCREASE IN DEFENSIVE STRENGTH (MEDIUM EFFECT) |
| | ATTACK + MAGICAL ATTACK |

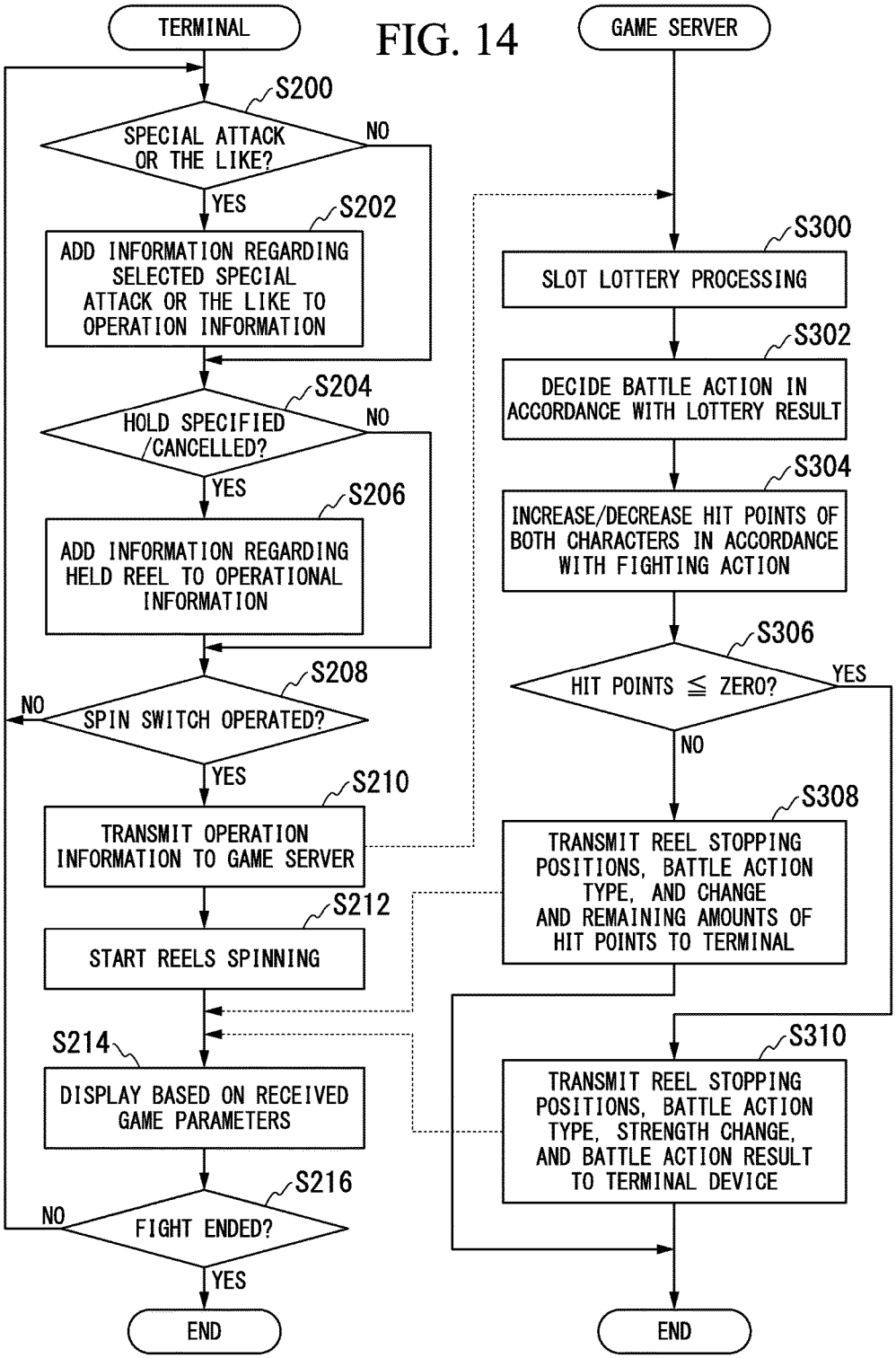
FIG. 14
TERMINAL
GAME SERVER
S200
SPECIAL ATTACK OR THE LIKE?
NO
YES
S202
ADD INFORMATION REGARDING SELECTED SPECIAL ATTACK OR THE LIKE TO OPERATION INFORMATION
S204
HOLD SPECIFIED /CANCELLED?
NO
YES
S206
ADD INFORMATION REGARDING HELD REEL TO OPERATIONAL INFORMATION
S208
SPIN SWITCH OPERATED?
NO
YES
S210
TRANSMIT OPERATION INFORMATION TO GAME SERVER
S212
START REELS SPINNING
S214
DISPLAY BASED ON RECEIVED GAME PARAMETERS
S216
FIGHT ENDED?
NO
YES
END
S300
SLOT LOTTERY PROCESSING
S302
DECIDE BATTLE ACTION IN ACCORDANCE WITH LOTTERY RESULT
S304
INCREASE/DECREASE HIT POINTS OF BOTH CHARACTERS IN ACCORDANCE WITH FIGHTING ACTION
S306
HIT POINTS ≦ ZERO?
YES
NO
S308
TRANSMIT REEL STOPPING POSITIONS, BATTLE ACTION TYPE, AND CHANGE AND REMAINING AMOUNTS OF HIT POINTS TO TERMINAL
S310
TRANSMIT REEL STOPPING POSITIONS, BATTLE ACTION TYPE, STRENGTH CHANGE, AND BATTLE ACTION RESULT TO TERMINAL DEVICE
END

GAME DEVICE, GAME CONTROL METHOD, AND STORAGE MEDIUM STORING A PROGRAM

CROSS-REFERENCE TO RELATED APPLICATION

This application claims the benefit of U.S. Provisional Application No. 61/806,193, filed Mar. 28, 2013.

BACKGROUND OF THE INVENTION

Field of the Invention

This disclosure of the present invention relates to a game device, a game control method, and a storage medium storing a program.

Description of the Related Art

Japanese Laid-open Patent Publication No. 2012-081316 discloses a known game device configured to provide a game in which characters battle with one another. This game device is configured to judge, under a prescribed relative advantage determining rule, the relative advantage between slot game patterns associated with the character on one side and the slot game patterns associated with the character on the other side, and to control, based on the relative advantage judgment, the attacking authority of the character on one side and the character on the other side to perform attacking control. This game device is also configured to determine the tricks used by the character on one side and the tricks used by the character on the other side, based on the slot game patterns associated with the respective characters.

SUMMARY

In one embodiment, a game device may include, but is not limited to, a lottery unit, a decision unit, and a determination unit. The lottery unit may be configured to decide stop positions of spinning slot reels of a first reel group displayed on a display. The decision unit may be configured to select a type of battle action among plural types of battle action, with reference to the stop positions of the spinning slot reels of the first reel group decided by the lottery unit. The decision unit may be configured to decide the selected type of battle action as a battle action by a player character. Each type of battle action has an attribution associated with a set of symbols of the slot reels at the stop positions. The plural types of battle action include a first type of battle action having a first attribution to attack an enemy character and a second type of battle action having a second attribution different from the first attribution. The determination unit may be configured to decrease hit points of the enemy character in response to battle action by the player character, and to decrease hit points of the player character in response to battle action by the enemy character. The determination unit may be configured to determine a winner based on respective remaining amounts of the hit points of the player character and the enemy character.

In another embodiment, a computer-implemented game control method may include, but is not limited to the following processes. A process is made to decide stop positions of spinning slot reels of a first reel group displayed on a display. A process is made to select a type of battle action among plural types of battle action, with reference to the stop positions of the spinning slot reels of the first reel group decided, so as to decide the selected type of battle action as a battle action by a player character, where each type of battle action has an attribution associated with a set of symbols of the slot reels at the stop positions, and where the plural types of battle action include a first type of battle action having a first attribution to attack an enemy character and a second type of battle action having a second attribution different from the first attribution. A process is made to decrease hit points of the enemy character in response to battle action by the player character. A process is made to decrease hit points of the player character in response to battle action by the enemy character. A process is made to determine a winner based on respective remaining amounts of the hit points of the player character and the enemy character.

In still another embodiment, a non-transitory computer readable medium that stores a computer program to be executed by a computer to perform a game control method. The method may include, but is not limited to the following processes. A process is made to decide stop positions of spinning slot reels of a first reel group displayed on a display. A process is made to select a type of battle action among plural types of battle action, with reference to the stop positions of the spinning slot reels of the first reel group decided, so as to decide the selected type of battle action as a battle action by a player character, where each type of battle action has an attribution associated with a set of symbols of the slot reels at the stop positions, and where the plural types of battle action include a first type of battle action having a first attribution to attack an enemy character and a second type of battle action having a second attribution different from the first attribution. A process is made to decrease hit points of the enemy character in response to battle action by the player character. A process is made to decrease hit points of the player character in response to battle action by the enemy character. A process is made to determine a winner based on respective remaining amounts of the hit points of the player character and the enemy character.

BRIEF DESCRIPTION OF THE DRAWINGS

The above features and advantages of the embodiments of the present invention will be more apparent from the following descriptions of certain illustrative embodiments taken in conjunction with the accompanying drawings, in which:

FIG. 11 is a view of a table of battle actions associated with a set of symbols on slot reels as lottery results;

FIG. 14 is a flow chart of processes to be processed by the terminal and the game server of FIG. 3;

DETAILED DESCRIPTION OF THE EMBODIMENTS

Embodiments of the invention will be now described herein with reference to illustrative embodiments. Those skilled in the art will recognize that many alternative embodiments can be accomplished using the teaching of the embodiments of the present invention and that the invention is not limited to the embodiments illustrated for explanatory purpose.

[Configuration]

Figure 1:
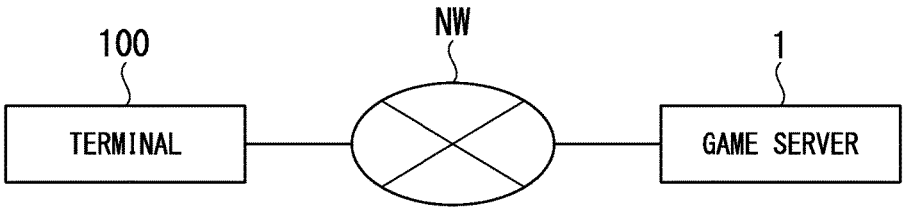
FIG. 1 is a view of a system for providing a computer-implemented game in accordance with a first preferred embodiment of the present invention.
Figure 2:
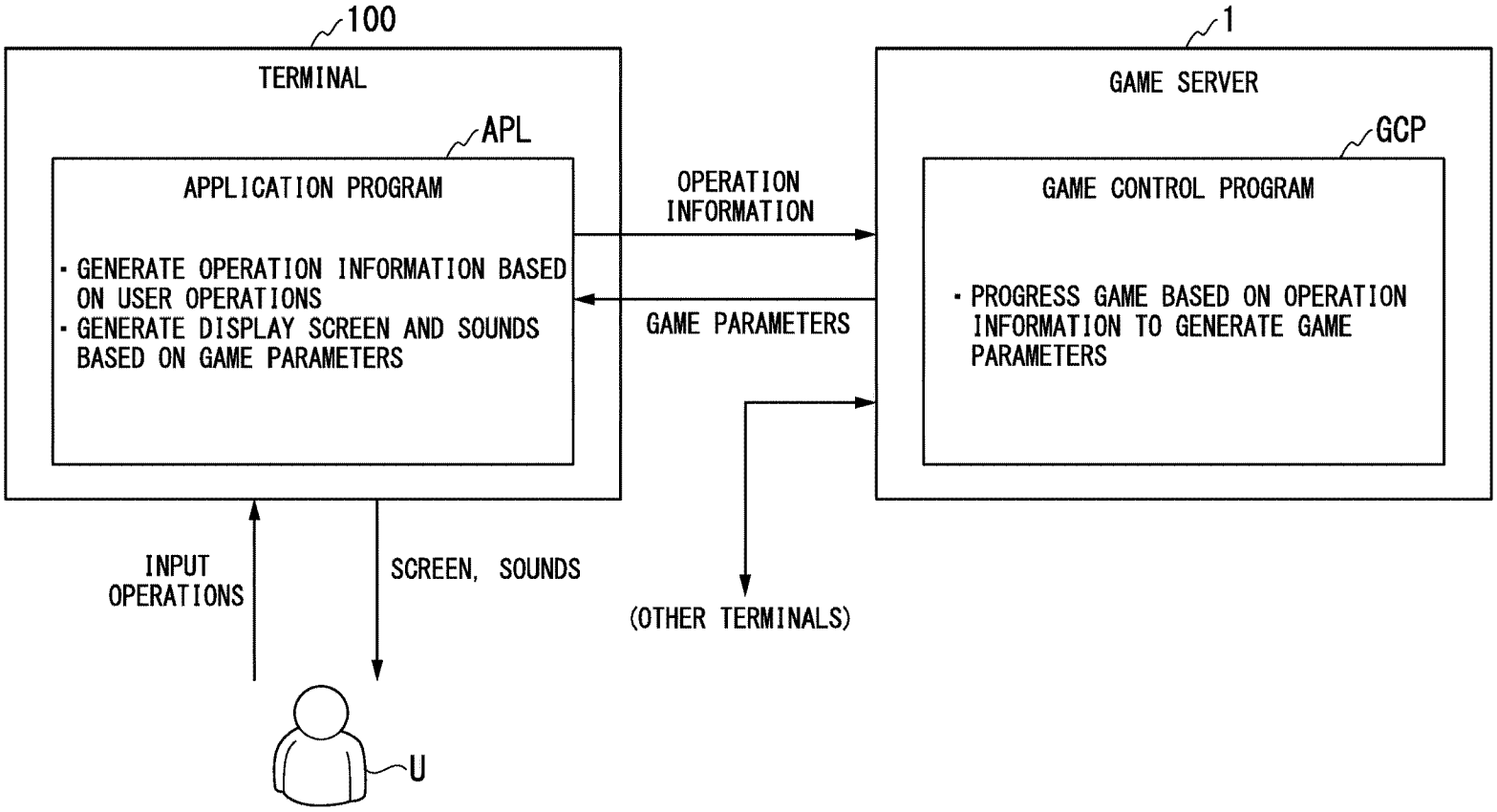
FIG. 2 is a view of assigned main roles to be played by a terminal and a game server included in the system of FIG. 1.

FIG. 1 shows the environment in which the game is provided in the embodiment of the present invention. FIG. 2 shows in schematic form the division of roles of components of the game device or game system, when the game of the embodiment of the present invention is provided. A user U (player) may make input operations to the game. A CPU (central processing unit) or the like is configured to execute an application program APL in a terminal 100. A game server 1 is configured to execute a game control program GCP by a CPU or the like. The application program APL is to generate operation information based on input operations made by a user U (player) of the terminal 100, and to transmit the operation information to the game server 1 via a non-illustrated communication unit. A game control program GCP is to progress through the game based on the operation information received from the terminal 100, and to generate games parameters based on the progression results and transmit the generated games parameters to the terminal 100. Upon receiving the game parameters from the game server 1, at the terminal 100 the application program APL generates display images and sounds, based on the game parameters, so as to output images and sounds to the user U (player). This division of roles is only merely one example. Data for displayed images, including data for rendering and image data itself, may be generated in the game server 1, and more processing may be done in the terminal 100. Also, the configuration may be one in which the terminal 100 does all the processing, and the network NW and game server 1 are not required.

Typical examples of the network NW may include various types of information communication network, such as a mobile telephone network, a PHS (Personal Handy-Phone System) network, a VPN (virtual private network), a dedicated communication circuit network, a WAN (wide area network), a LAN (local area network), a PSTN (public switched telephone network), or a combination thereof.

Figure 3:
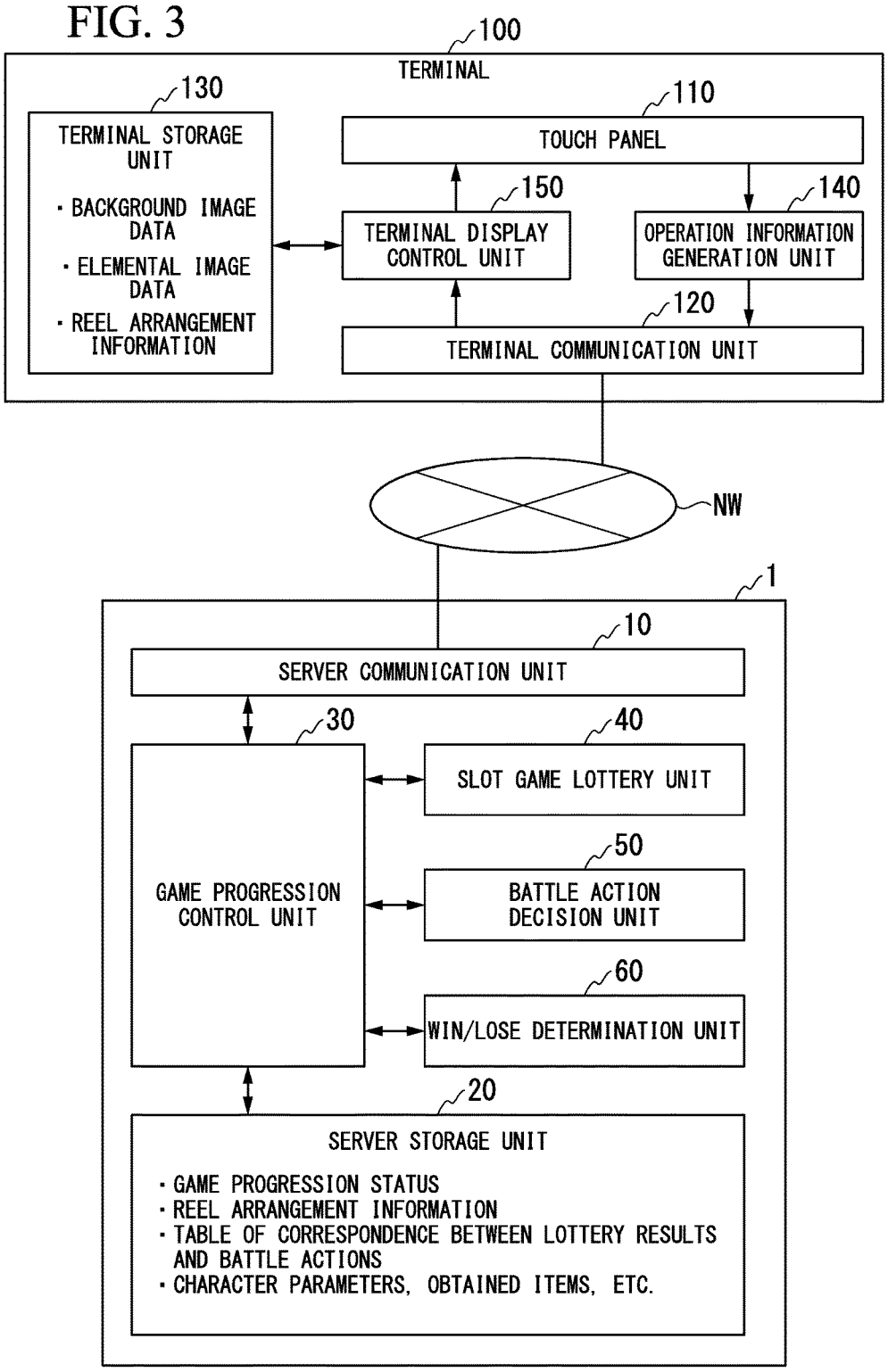
FIG. 3 is a view of configurations of a terminal and a game server included in the system of FIG. 1.

FIG. 3 shows an example of a functional configuration of the game server 1 and the terminal 100 of the embodiment of the present invention. The terminal 100 will be described first. The terminal 100 may be a terminal used by a player, for example, a mobile telephone, a tablet terminal, a personal computer, or a dedicated game console or the like. The terminal 100 may have, for example, a touch panel 110, a terminal communication unit 120, a terminal storage unit 130, an operation information generation unit 140, and a terminal display control unit 150.

The touch panel 110 of the terminal 100 may be configured, for example, by a liquid crystal display device or an organic EL (electroluminescence) display device, which is combined with a contact sensing mechanism that senses contact by a player, using a capacitive method, a resistive film method, an infrared method, a surface acoustic wave method, or the like. In place of or in addition to the contact sensing mechanism of the touch panel 110, the terminal 100 may have a different type of input device such as a button, a key, a mouse, or a touch pad.

The terminal communication unit 120 may be configured to communicate with a server communication unit 10 of the game server 1, via the network NW. The terminal storage unit 130 is used to store, for example, results of various processing in the terminal 100 in addition to storing the above-mentioned application program APL. The operation information generation unit 140 and the terminal display control unit 150 may be configured to be combinations of hardware with software which functions by the CPU of the terminal 100 executing the application program APL. The operation information generation unit 140 is configured to interpret an operation made by a player on the touch panel 110, to generate the operation information and to transmit the operation information to the game server 1. The terminal display control unit 150 may be configured to generate display images based on game parameters received by the terminal communication unit 120 from the game server 1.

The terminal display control unit 150 may be configured to display the same on the touch panel 110.

The game server 1 may include, for example, a server communication unit 10, a server storage unit 20, a game progression control unit 30, a slot game lottery unit 40, a battle action decision unit 50, and a win/lose determination unit 60. The game progression control unit 30, the slot game lottery unit 40, the battle action decision unit 50, and the win/lose determination unit 60 may be, for example, hardware combined with software functional units that function by the CPU of the game server 1 executing the game control program GCP. The server communication unit 10 may be configured to communicate with the terminal communication unit 120 of the terminal 100, via the network NW. The server storage unit 20 may be configured to store, for example, results of various processing in the game server 1, in addition to storing the above-mentioned game control program GCP. The game progression control unit 30 may be configured to perform overall control of the game provided in the terminal 100. The game progression control unit 30 may be configured to generate game parameters. The game progression control unit 30 may be configured to control the server communication unit 10, so as to transmit the generated game parameters to the terminal 100. The slot game lottery unit 40 may be configured to perform lotteries regarding the slot game executed within the game. The slot game lottery unit 40 may be configured to decide the stop positions of the slot reels. The battle action decision unit 50 may be configured to decide the battle action of the player character and the battle action of an enemy-side character (hereinafter referred to as an "enemy character"), in response to the processing results of the slot game lottery unit 40. The win/lose determination unit 60 may be configured to calculate the variation amount of hit points of each character in accordance with the battle action of the player character and the battle action of the enemy character. The win/lose determination unit 60 may be configured to determine a win or a loss outcome, based on the remaining amounts of hit points. In the game of the embodiment of the present invention, "character" is not limited to being a character visualized by a character image, but may also be a character having only parameters and not having a character image. Also, an enemy character may be, for example, an NPC (non-player character) controlled by the game server 1 or the CPU of the terminal 100.

The terminal storage unit 130 may be configured to store, for example, background image data of each mode of the game and elemental image data (image data for characters, slot reel symbols, display parameters, and items, and reel symbol arrangement information and the like. The server storage unit 20 may be configured to store, for example, data indicating the progression status of the game, reel symbol arrangement information, a table of correspondence between slot game lottery results and battle actions, character parameters, and won items. The terminal display control unit 150 may be configured to generate, for example, game images by embedding elemental image data into the background image data, in accordance with the progression status of the game indicated by the game parameters. The terminal display control unit 150 may alternatively be configured to perform rendering and display images based on data for image rendering received from the game server 1. The terminal display control unit 150 may be configured to display image data received from the game server 1. The terminal storage unit 130 and the server storage unit 20 may redundantly be configured to store various data.

[Game Progression (First Mode)]

FIG. 4 to FIG. 9 show an example of the transition of the screens up until reaching the "slot device battle" in the game of the embodiment of the present invention. The terminal display control unit 150 of the terminal 100 may be configured to display the following screens on the touch panel 110, based on data indicating the game progression status included in the game parameters received from the game server 1.

Figure 4:
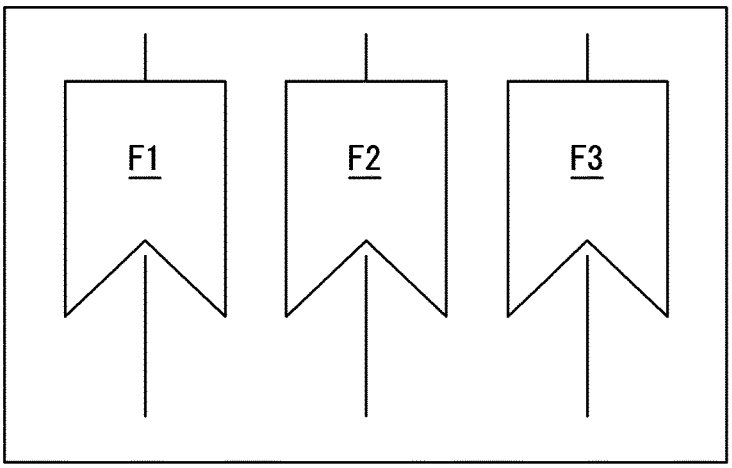
FIG. 4 is a view of an image displayed on a display screen of the terminal of FIG. 3 in a step involved in a series of processes before a battle mode to be made using slot reels in the game.

In the screen shown in FIG. 4, the player may select from a plurality of groups symbolized by flags (F1, F2, and F3) the group to which the player character will belong. The lottery operation is performed, for example, by the player tapping a part of the touch panel 110 in which the flag is displayed and also tapping a non-illustrated verification button. When this operation is made, the operation information generation unit 140 of the terminal 100 generates and transmits to the game server 1 operation information responsive to the operation. In response to the received operation information, the game progression control unit 30 of the game server 1 updates the game progression status and transmits game parameters indicating the game progression status to the terminal 100. The terminal 100 causes display on the touch panel 110 of a screen responsive to the immediately previously received game progression status. Thereafter, the same type of processing is performed in accordance with various lottery operations.

Figure 5:
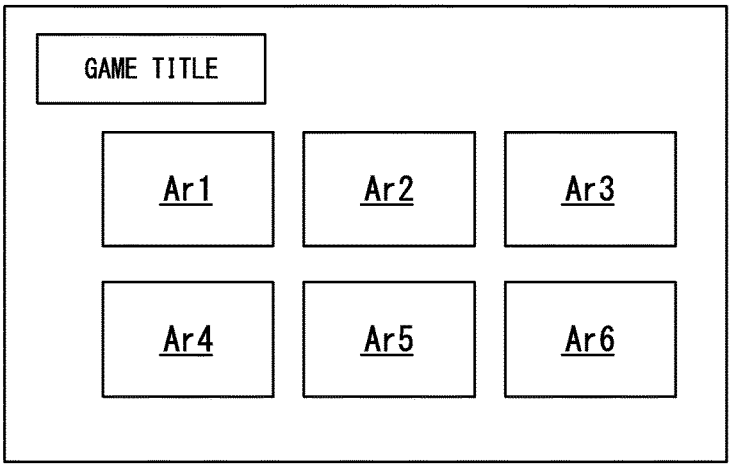
FIG. 5 is a view of an image displayed on a display screen of the terminal of FIG. 3 in a step, subsequent to the step of FIG. 4, involved in the series of processes before a battle mode to be made using slot reels in the game.
Figure 6:
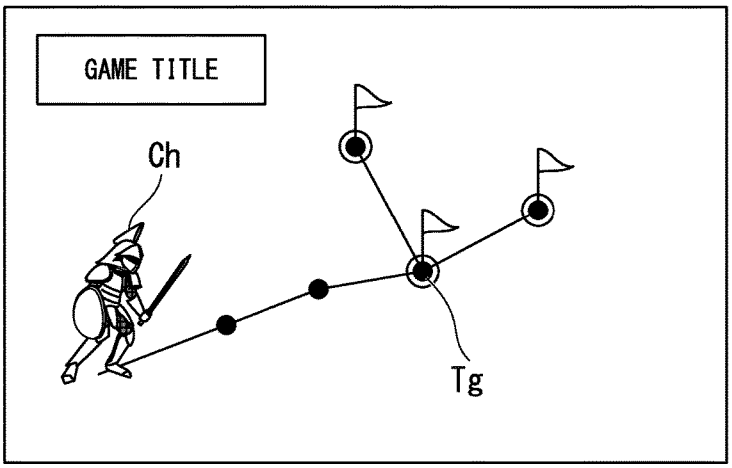
FIG. 6 is a view of an image displayed on a display screen of the terminal of FIG. 3 in a step, subsequent to the step of FIG. 5, involved in the series of processes before a battle mode to be made using slot reels in the game.
Figure 7:
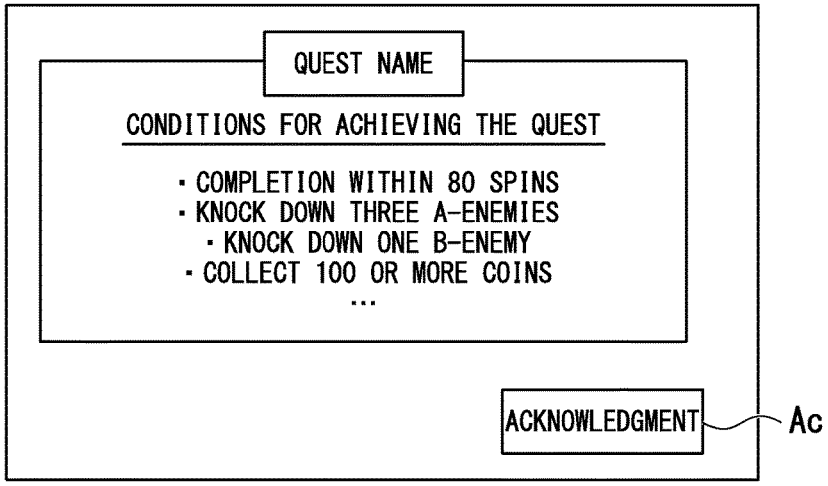
FIG. 7 is a view of an image displayed on a display screen of the terminal of FIG. 3 in a step, subsequent to the step of FIG. 6, involved in the series of processes before a battle mode to be made using slot reels in the game.
Figure 8:
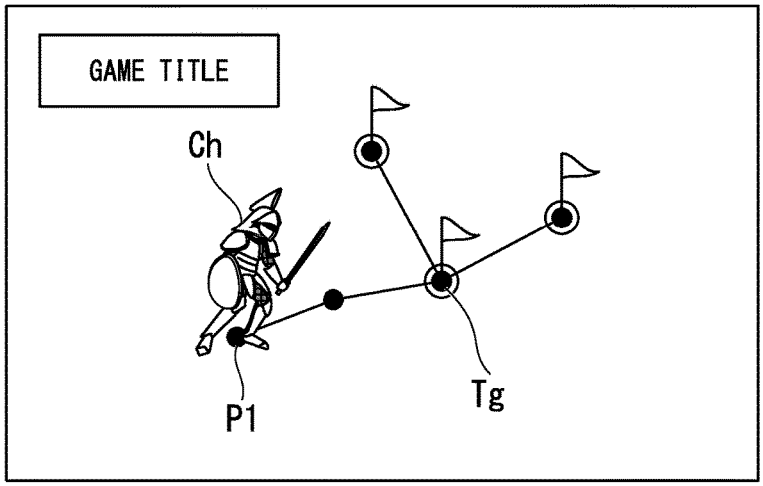
FIG. 8 is a view of an image displayed on a display screen of the terminal of FIG. 3 in a step, subsequent to the step of FIG. 7, involved in the series of processes before a battle mode to be made using slot reels in the game.
Figure 9:
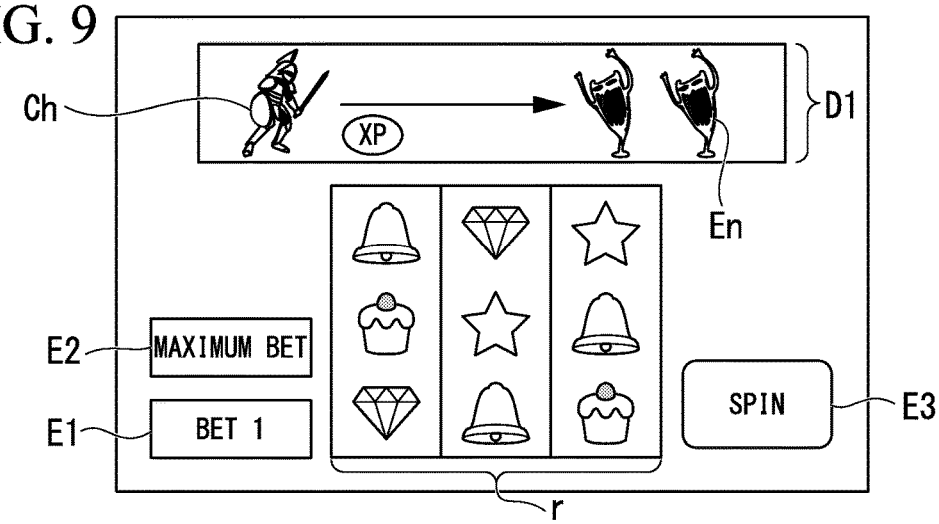
FIG. 9 is a view of an image displayed on a display screen of the terminal of FIG. 3 in a step, subsequent to the step of FIG. 8, involved in the series of processes before a battle mode to be made using slot reels in the game.

When a group is selected, the screen shown in FIG. 5 is displayed. In the screen shown in FIG. 5, the player selects the region that the player character Ch will adventure in, from a plurality of regions displayed in a region display (Ar1 to Ar6). When the region is selected, the screen shown in FIG. 6 is displayed, and the position of the player character Ch and the target point Tg is shown to the player. When the target point Tg is selected, the acknowledgment screen for quest achievement conditions shown in FIG. 7 is displayed. When the player makes an operation acknowledging the quest achievement conditions (operates the acknowledge button Ac), the player character Ch moves toward the target point Tg, and the screen shown in FIG. 8 is displayed. As shown in FIG. 8, when the player character Ch reaches the intermediate point P1 leading up to the target point Tg, an event occurs, and transition is made to the first mode. FIG. 9 is an example of a screen showing the first mode. In the first mode, various items and game currency are obtained, and experience points required to increase the player characters level are obtained. In the first slot game in the first mode, with each spin of the reel group r, the player character Ch advances by one step in the direction of the arrow in the progress window D1, and when it reaches the position of the enemy character En, the second mode starts. A point P1 at which experience points are obtained is set within the progress window D1, and when the player character Ch passes the point XP, the player character is given experience points. In the first mode, in addition to experience points, points are provided, which when passed or reached, result in the granting of items or game currency.

A "Bet 1" button E1 that instructs the betting of a minimum unit of game currency by a player, a "MAX Bet" button E2 that instructs the betting of the maximum unit of game currency, and a "SPIN" button E3 that instructs the spinning of the slot reel group r with at least the minimum game currency bet, and the like, are provided in the screen showing the first mode.

[Slot Game Battle (Second Mode)]

Figure 10:
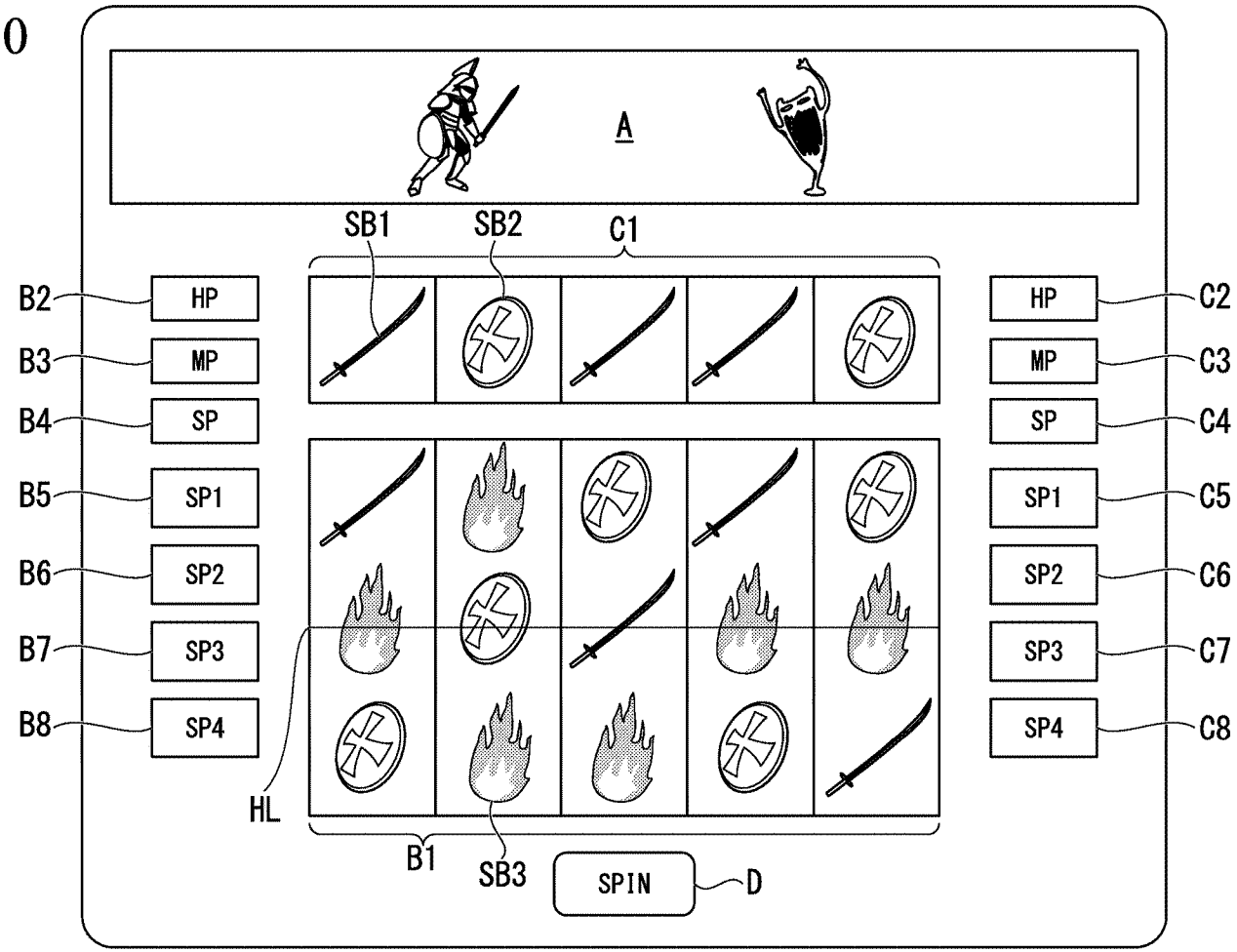
FIG. 10 is a view of an image displayed on a display screen of the terminal of FIG. 3 in a step involved in a battle mode as a second mode to be made using slot reels in the game.

FIG. 10 is an example of a display screen in the second mode. There are displayed a battle animation screen A, a player character reel group B1, a hit point gauge B2 displaying the maximum value and remaining amount of the player character hit points (HP), a magical power gauge B3 displaying the maximum value and remaining amount of the player character magical power (MP), a special attack gauge B4 displaying the maximum value and the remaining amount of the player character special attack power (SP), a list of attacks B5 to B8 displaying magical attacks, special attacks, defenses, recoveries, and other battle actions (SP1 to SP4) that the player character can invoke, along with the consumed magical power and consumed special attack power, an enemy character (opponent character) reel group C1, a hit point gauge C2 displaying the maximum value and remaining amounts of enemy character hit points (HP), a magical power gauge C3 displaying the maximum value and the remaining amount of the enemy character magical power (MP), a special attack power gauge C4 displaying the maximum value and remaining amount of the enemy character special attack power (SP), and a list of attacks C5 to C8 displaying special attacks, magical attacks, defenses, recoveries, and other battle actions (SP1 to SP4) that the enemy character can invoke, along with the consumed magical power and consumed special attack power. The parameters that are the basis for these displays are, for example, stored as character parameters in the server storage unit 20 and transmitted to the terminal 100 when parameter changes occur by game server 1 processing. A spin switch D for the purpose of spinning the reel groups B1 and C1 is displayed on the display screen of the second mode.

When the spin switch D is operated, the slot reels included in the reel groups B1 and C1 are displayed to show them spinning, for example, vertically, and, after some time elapses, automatically and simultaneously stopping. The slot reels included in the reel groups B1 and C1 have not only the parts that are displayed on the screen, but also parts that exist virtually in the background and a "reel spinning" means the successive appearance on the screen in a prescribed sequence of a part of the reel in the arrangement sequence thereof. Rather than the slot reels stopping simultaneously, the slot reels may be displayed so as to successively stop in a random sequence. Also, the slot reels may be displayed so as to spin horizontally.

When the slot reels included in the reel groups B1 and C1 stop, by damage being imparted to the enemy character, for example, based on the basic attack power of the player character and the basis defensive strength of the enemy character, an image of the enemy character with reduced hit points is displayed. By damage being imparted to the player character based on the basic defense strength of the player character and the basic attack power of the enemy character, an image of the player character with reduced hit points is displayed. The amounts of reduced hit points, or increased hit points in the case of recovery action, are, for example, calculated in the game server 1, and the amounts of change in hit points after hit points changes are transmitted to the terminal 100 as game parameters.

If the same symbol aligns along the hit line HL at all columns (a row at a prescribed position, such as the center row), a battle action having attributes in accordance with the symbol is executed. In the present embodiment, the term attribute refers a type of battle action, such as an attack (attack with a weapon and/or attack by magic), a defense (defense by protective gear and/or defense by magic), or recovery.

As the symbols on the slot reels, for example, three types are provided, a saber (SB1) showing an attack attribute as the battle action attribute, a shield (SB2) showing a defense attribute as the battle action attribute, and a flame (SB3) showing a magical attribute as the battle action attribute. Instead of (or in addition to) these, some type of symbol indicating recovery (for example, recovery medicine) may be provided.

In the reel group B1, when a saber (SB1) is arranged on all reels along the hit line HL, more damage is imparted to the enemy character than the damage based on the normal attack power of the player character. When the shield (SB2) is arranged at all columns along the hit line HL, the defensive strength is increased, for example, for a certain period of time, during which damage imparted from the enemy character is reduced. When a flame (SB3) is arranged at all columns along the hit line HL, a magical attack is invoked and a large damage is imparted to an enemy character that has the property of being particularly susceptible to magic. Although it is not illustrated, hit points of the player character may recover if recovery medicine is arranged in all columns along the hit line HL.

It is not necessary that all of these symbols be present. For example, a battle action may be executed in accordance with the most numerous attribute, and a plurality of battle actions may be executed in accordance with the number of corresponding symbols that have stopped along the hit line HL. This applies also to the reel group C1, in which case the damage imparted to the player character by the enemy character increases, and the defensive strength of the enemy character increases. Also, the intension or weakness of battle actions, such as attack power, defensive strength of recovery, may be decided in accordance with the types and numbers of symbols of each reel of the reel group B1 stopped on the hit line HL.

Battle action execution rules such as this are established, for example, by a table of correspondence between lottery results and battle actions stored in the server storage unit 20. FIG. 11 is an example of a table of correspondence between lottery results and battle actions. In FIG. 11, the long dashes indicate arbitrary symbols. Although, as a convenience, symbols are shown to be left-justified, this does not impose a condition on the sequence of symbols arranged along the hit line HL.

[Special Attacks]

In reel group B1, when there are sabers (SB1) present at all columns along the hit line, the special attack power is increased, this being reflected by the special attack gauge B4, and when flames are arranged along the hit line HL, the magical power increases, this being reflected in the magical power gauge B3. If these exceed the consumed special attack power or consumed magical power of the special attack and magical attack noted in the list of attacks B5 to B8, the player can select and cause execution of a special attack, a magical attack, a defense, a recovery, or another battle action. When a special attack is executed, the special attack power is consumed in accordance with the type thereof. When a magical attack is executed, the magical power is consumed in accordance with the type thereof. If, as result of consumption of special attack power, the special attack power reflected in the special attack gauge B4 is lower than the consumed special attack power, a special attack is not possible until special attack power is accumulated until it exceeds the consumed special attack power. Also, if, as a result consumption of magical power, the magical power reflected in the magical power gauge B3 is lower than the consumed magical power, a magical attack is prohibited until it exceeds the magical power consumption. Special attacks that are provided include such attacks as an attack adding damage to an enemy character to hit points of the player character, an attack destroying a shield with which the enemy character is fitted, and an attack increasing the basic attack power of the player character for a certain amount of time.

[Hold Function]

Before operating the spin switch D, the player can stop a desired reel of the reel group B1 and cause the remaining reels to spin. This function will be referred herein as the hold function. The hold is started or released by the player touching the desired reel. However, a plurality of reels with different symbols stopped on the hit line HL cannot be simultaneously held. When the spin switch D is operated from the hold condition, the remaining reels spin.

Figure 12:
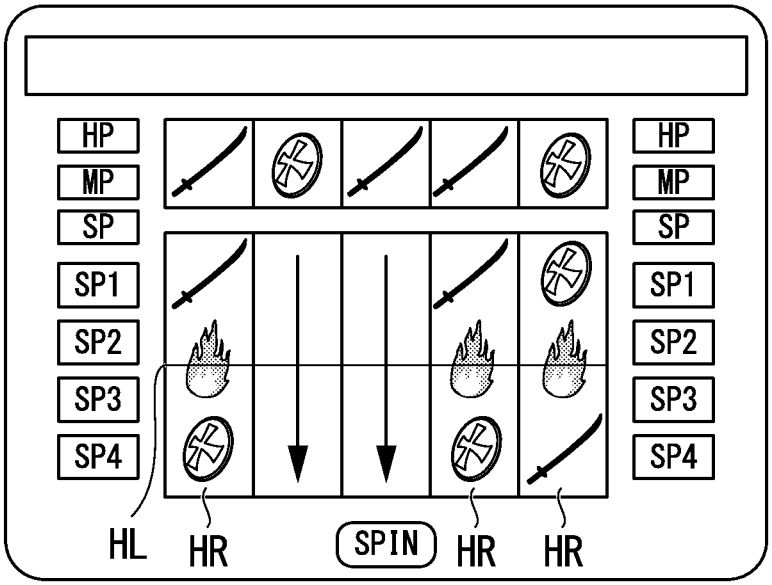
FIG. 12 is a view of an image displayed on a display screen of the terminal of FIG. 3 in a spinning step of parts of reels while holding the remaining slot reels.
Figure 13:
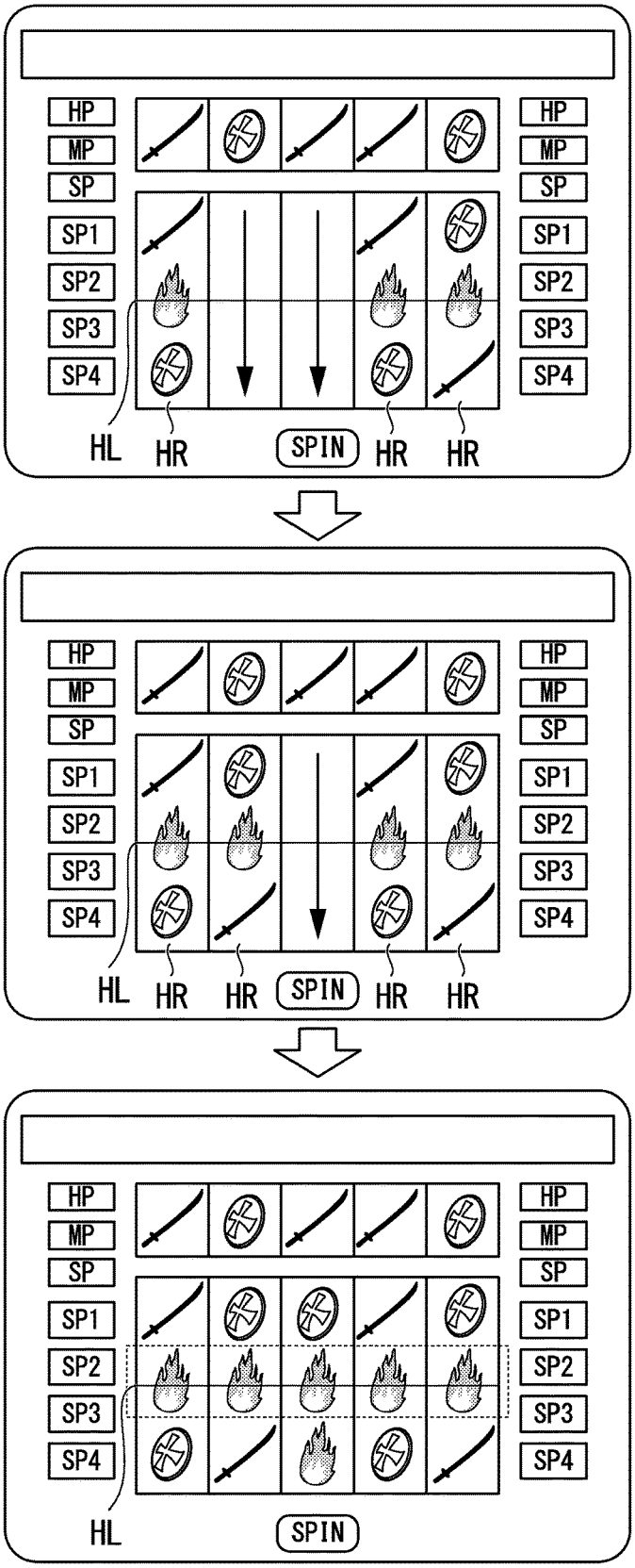
FIG. 13 is a view of images displayed on a display screen of the terminal of FIG. 3 in a series of holding processes in spinning parts of the slot reels while holding the remaining slot reels.

FIG. 12 shows the condition in which the spin switch D has been operated from the hold condition. In FIG. 12, HR indicates the held reel. After that, when the slot reels that have spun stop, reels that stop with the same symbol as the already held reel on the hit line HL also automatically go into the hold condition. As a result, the possibility of a symbol being present on the hit line HL on each reel increases, making it possible to achieve speedier progress through the game. FIG. 13 shows, in schematic form, the condition in which the number of held reels gradually increases until the symbols of each reel appear on the hit line HL. In some cases, the hold function may be made invoked at any time. In other cases, the hold function may be made invokable in response to an operation by the player. In still other cases, the hold function may be made invokable when a prescribed condition is satisfied.

[Processing Flow]

FIG. 14 is an example of a flowchart showing the flow of processing executed by the terminal 100 and the game server 1 of the present embodiment.

First, the operation information generation unit 140 of the terminal 100 judges whether or not the player has selected a special attack, a magical attack, a defense, a recovery, or another battle action (step S200). If the player has selected a special attack or the like, the operation information generation unit 140 adds information regarding the selected special attack or the like to the operation information to be transmitted next (step S202).

If the player has cancelled a specification for a special attack or the like, the operation information generation unit 140 deletes the operation information regarding the specified special attack or the like from the operation information, although this is not illustrated. If the player has selected a special attack or the like, the operation information generation unit 140 immediately generates and transmits the operation information to the game server 1. The operation information generation unit 140 may internally set a flag, so that, immediately before transmitting the operation information, the flag that is set is reflected in the operation information, rather than correcting the operation information itself that is to be transmitted. This applies the information regarding hold, which will be described below.

The operation information generation unit 140 of the terminal 100 judges whether or not the player has specified the hold or release of hold of a reel (step S204). If the player has specified or released the hold of a reel, the operation information generation unit 140 adds to the operation information to be transmitted next information regarding the slot reels that result in being held (step S206).

Next, the operation information generation unit 140 of the terminal 100 judges whether or not the player has operated the spin switch (step S208). When the player operates the spin switch, the operation information generation unit 140 of the terminal 100 transmits the operation information at that point in time, including the information that is added at steps S202 and S206 and information indicating that the spin switch has been operated, to the game server 1 (step S210). Then, the terminal display control unit 150 of the terminal 100, along with transmitting the operation information, causes an image to be displayed on the touch panel 110 of the reel groups B1 and C1 that have started spinning (step S212). The terminal display control unit 150 of the terminal 100 may display on the touch panel 110 the reel groups B1 and C1 that have started spinning after receiving a response of game parameters from the game server 1. The operation information generation unit 140 repeats execution of steps S200 to S208 during the time in which the player is operating the spin switch.

Upon receiving the operation information, the slot game lottery unit 40 of the game server 1 performs slot game lottery processing (step S300). That is, it decides the stop positions of the slot reels of the reel group B1 that are to spin and of each of the slot reels of the reel group C1, by random number processing or the like.

The battle action decision unit 50 of the game server 1 references the lottery results, stop positions of each reel, by the slot game lottery unit 40 and decides a battle action as the battle action of the player character that is associated with the symbols that have stopped along the hit line HL (step S302). The battle action decision unit 50 decides the enemy character battle action, in accordance with the symbols that are to stop at a prescribed position in the reel group C1, the position of display on the screen in the example of FIG. 10.

When the battle actions are decided, the win/lose determination unit 60 increases or decreases hit points of the characters, in accordance with the presence or absence of a battle action or a special attack by both the characters (step S304). Specifically, in accordance with a battle action of the player character, the win/lose determination unit 60 decreases hit points of the enemy character and increases the defensive strength of the player character, and causes the player character to recover hit points. The win/lose determination unit 60 also performs processing such as processing to reduce hit points of the player character, in accordance with the battle action of the enemy character.

Then, as a result of the processing of step S304, the win/lose determination unit 60 determines whether or not hit points of one of the characters is zero or below to determine which wins and lose in the battle game (step S306). If hit points of both characters are greater than zero, the game progression control unit 30 of the game server 1 transmits as game parameters to the terminal 100 the stop positions of each reel that was spun and types of battle action, and the change and remaining amount of hit points of both characters or only one thereof. However, if hit points of one of the characters is zero or below, the game progression control unit 30 transmits as game parameters to the terminal 100 the stop positions of each reel that was spun and types of battle action, the change in hit points of both characters, and the result of the battle, making the one of which hit points has become zero or lower the loser, (step S310).

The terminal display control unit 150 of the terminal 100 controls the touch panel 110 so as to make a display based on the game parameters received from the game server 1 (step S214). Specifically, if the reel groups B1 and C1 have already begun to spin, then the terminal display control unit 150 stops each of the reel groups B1 and C1 at the stop positions indicated by the game parameters. If, however, the reel groups B1 and C1 have not yet begun to spin, the terminal display control unit 150 spins them and, after some time has elapsed, stops each of the reel groups B1 and C1 at the stop positions indicated by the game parameters. After that, the terminal display control unit 150 displays an image that corresponds to the battle action, reflects the variation in parameters such as hit points in the screen, and, if battle results are received from the game server 1, displays win/lose or the like. If the battle has not ended, the terminal display control unit 150 of the terminal 100 returns to step S200, and if the battle has been ended, the processing of the flowchart of FIG. 14 is ended (step S216).

In this manner, in the game of the present embodiment, by imparting mutual damage in accordance with the symbols stopped at the prescribed positions of the reel groups B1 and C1, when the enemy character hit points becomes zero, the player character wins. When the player character wins, game currency, items for game advantage, and experience points and the like are granted to the player character. As long as hit points of the player character does not become zero, when the second mode is completed, transition is made to the first mode. When the first mode ends, transition is made to the screen shown as an example in FIG. 6. As noted above, the battle action is not restricted to being decided by the results of one spin of the reel groups, and the battle action may be decided based on the results of a plurality of spins of the reel groups. The battle actions may be executed in steps in accordance with reel groups stopping in steps, so that when a part of the slot reels has stopped and a battle action in accordance with the stop positions has been executed, this is followed by other reels stopping and a battle action being executed in accordance with those stop positions.

[Other Screens]

Figure 15:
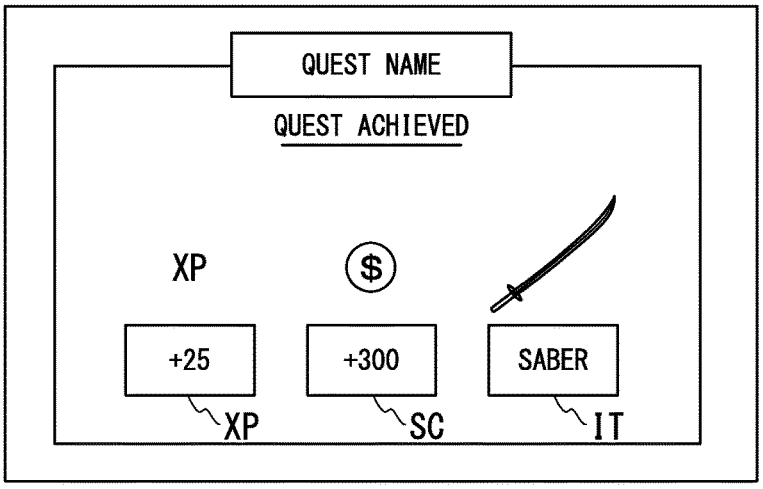
FIG. 15 is a view of an image displayed on a display screen of the terminal of FIG. 3 where a player character satisfies question conditions and the question is completed.

FIG. 15 is an example of a screen displayed when the player character satisfies conditions for achieving a quest, and the quest is completed. When a quest ends, the game currency (SC) or experience points (XP), and items (IT) granted to the player character as a result of the quest are displayed. A quest is not necessarily successful, and when a player character loses a battle, for example, when the number of spins during the quest reaching an upper limit value, the quest is treated as having failed.

Figure 16:
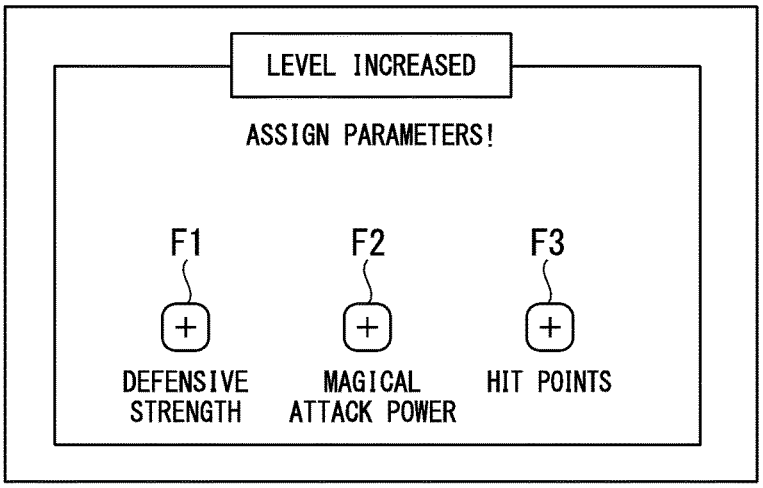
FIG. 16 is a view of an image displayed on a display screen of the terminal of FIG. 3 where experience points given to a player character exceeds a reference value and the player character increases in level.

FIG. 16 is an example of a screen displayed when the experience points granted to the player character exceeds a reference value, and the level of the player character increases. When the level of the player character increases, the player, by operating the assignment buttons (F1, F2, and F3), can assign prescribed points to the player character abilities such as attack power, defensive strength, magical power, and hit points.

Figure 17:
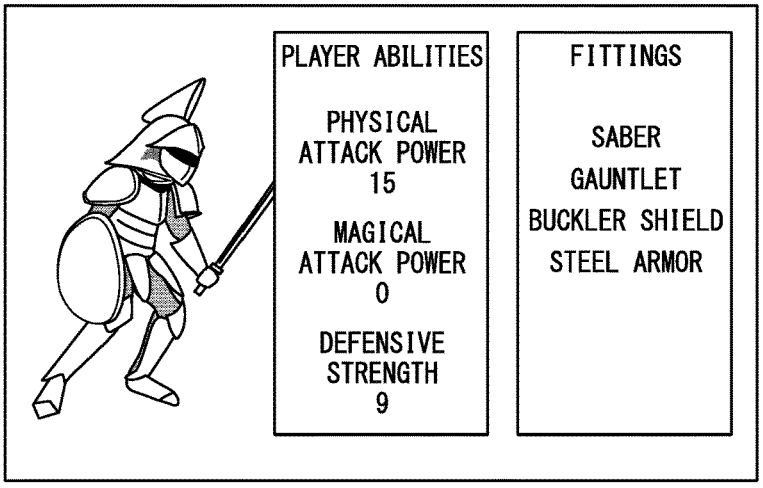
FIG. 17 is a view of an image describing the current status of a player character displayed on a display screen of the terminal of FIG. 3.

FIG. 17 shows an example of a screen displaying the player status. The player can verify not only the player character abilities such as attack power, defensive strength, and hit points, or the like, but also weapons and defensive gear with which the character is fitted. All or a part of the abilities of the player character abilities may be the basic abilities of the player character, to which additions are made by the fitting of gear.

Figure 18:
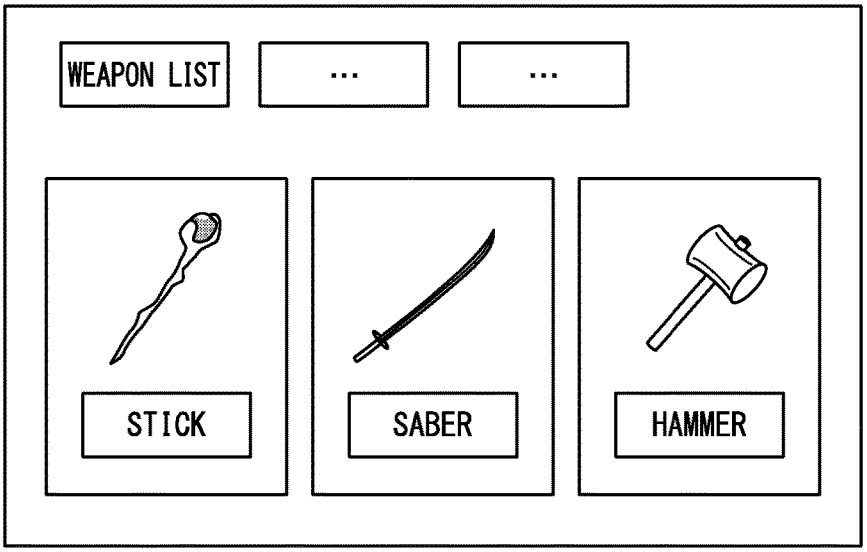
FIG. 18 is a view of an image showing a list of weapons and defensive gears fittable to the player character.
Figure 19:
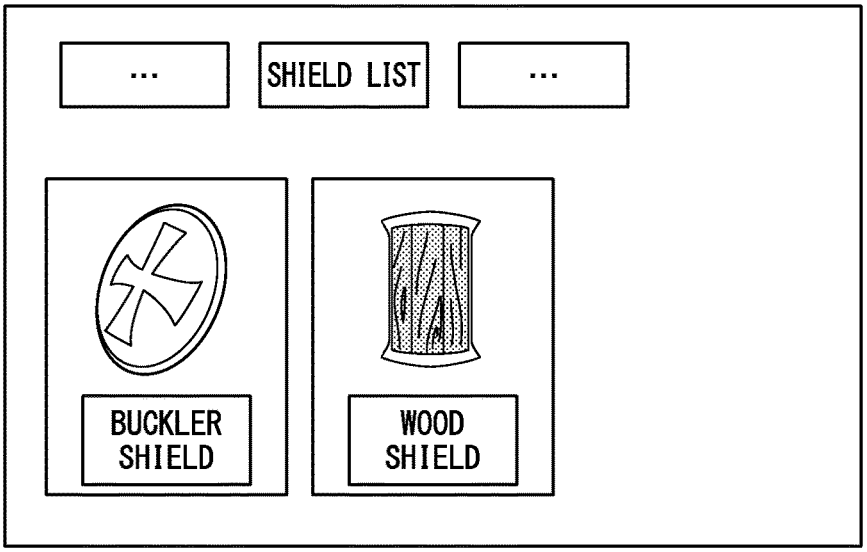
FIG. 19 is a view of an image of a list of shields in the defensive gears fittable to the player character.

FIG. 18 shows an example of a screen displaying a list of weapons and defensive gear fittable to the player character. FIG. 19 shows an example of a screen displaying, of the defensive gear with which the player character can be fitted, a list of shields. In addition to shields, accessories, armor, gloves (gauntlets), and shoes are available as defensive gears. The player can view a list of weapons and defensive gears that it has and a list of purchasable weapons and defensive gears.

Figure 20:
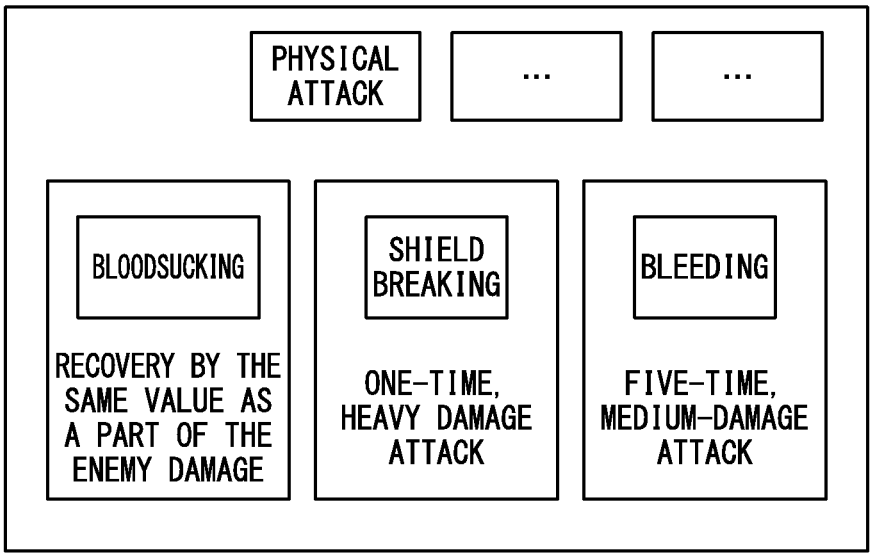
FIG. 20 is a view of an image of a list of special attacks, magical attacks, defenses, recoveries, and other battle actions purchasable by the player.
Figure 21:
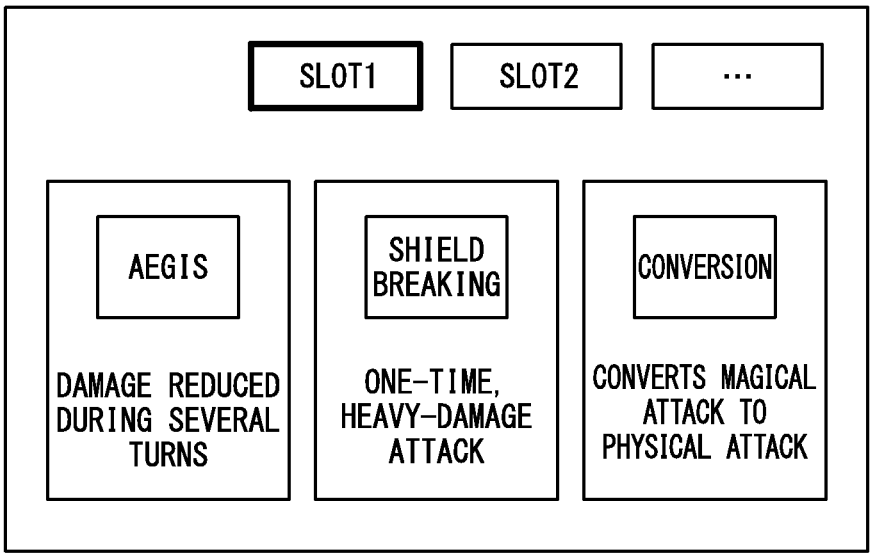
FIG. 21 is a view of an image of the player records special attacks, magical attacks, defenses, recoveries, and other battle actions in the attack lists.

FIG. 20 shows a list of special attacks, magical attacks, defenses, recoveries, and other battle actions purchasable by the player. The player can view of a list of special attacks, magical attacks, defenses, recoveries, and other battle actions that it has and a list of purchasable special attacks, magical attacks, defenses, recoveries, and other battle actions. FIG. 21 shows an example of a screen from which the player records special attacks, magical attacks, defenses, recoveries, and other battle actions in the attack lists B5 to B8 (indicated as SLOT1, SLOT2, . . . in FIG. 21).

SUMMARY

According to the embodiments of the game device, the game control method, and the storage medium described above, hereinafter referred to as "game device and the like", battle action having attributes of attack, magic, defense, recovery and the like is done in accordance with the symbols at the stop positions of the slot reels. This will make it possible to broaden the scope of the battle action that the character executes, and to build game excitement. The scope of battle action broadens and, for example, with only a tiny small amount of remaining hit points, by executing a defense or recovery battle action, the player character can escape from a precarious situation, thus enabling the development of a thrill-packed game. As a result, the motivation to play the game can be increased, compared with merely deciding the relative strength and type of attacks in accordance with the slot game results.

According to the game devices, more thrilling games are provided by displaying on the game screen a reel group associated with the player character and a reel group associated with the enemy character and by having the opponent take battle action in accordance with the symbols stopping at prescribed positions of each reel.

According to the game devices, by providing a hold function by which the player maintains the stopped condition of a desired reel, the probability of arranging symbols along the hit line HL can be increased, thereby achieving speedier game developments.

[Modifications]

Although the foregoing has been descriptions of the embodiments of the present invention, the present invention is not restricted to such embodiments, and can be subjected to various variations and replacements, within the scope of the spirit thereof.

For example, although in the above-mentioned embodiment the terminal 100 and the game server 1 communicate each time of spinning in the slot game, and the lottery results, stop position of the slot reels, by the slot game lottery unit 40 are transmitted by the game server 1 to the terminal 100, this is not a restriction. For example, the terminal 100 and the game server 1 may be caused to communicate in units of groups in the first mode and the second mode. The term "in units of groups" typically means, for example, that the terminal 100 and the game server 1 communicate at some pre-established timing, such as at the start or end of a quest, or the start or end of a battle using the slot game.

In the above case, at the above-mentioned occurrence of communication, the game server 1 may transmit to the terminal 100 the stop positions for a plurality of times, or a random numbers used as the basis for the calculation thereof all at once. For example, at the start of a battle by a slot game, the reel stop positions for the upper limit of the number of spins (or up until the end of the battle) are decided by the slot game lottery unit 40 and transmitted to the terminal 100, and each time the terminal operates the spin switch, the terminal 100 successively accesses the reel stop positions of the received number of times and stops the slot reels. Alternatively, for example, at the start of a battle by a slot game, the slot game lottery unit 40, the battle action decision unit 50, and the win/lose determination unit 60 may decide game parameters that include the reel stop positions for a plurality of times, and the win/lose outcome based thereon, and the game server 1 transmits these to the terminal 100, the terminal 100 deciding the displayed content by successively referencing the received information each time the player operates the spin switch.

Figure 22:
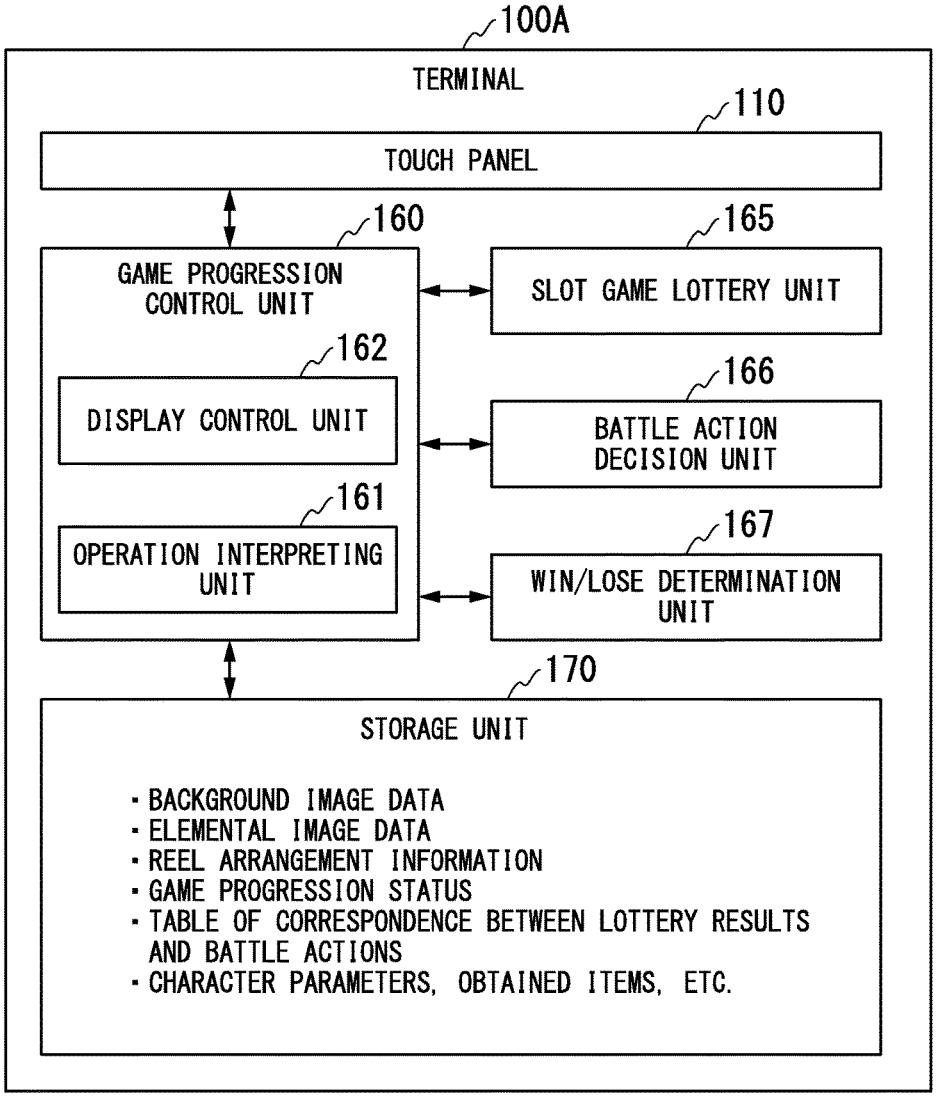
FIG. 22 is a view of configurations of a terminal performing alone as a game device.

Although in the above-mentioned embodiment the game server 1 performs processing regarding the game progression, the processing regarding the game progression may be performed by the terminal, the terminal functioning as a stand-alone game device and, of course, supplementary information may be communicated with the game server. FIG. 22 shows an illustrative embodiment of the configuration of a terminal 100A configured to function as a stand-alone game device. In FIG. 22, the terminal 100A has, for example, a touch panel 110, a game progression control unit 160, a slot game lottery unit 165, a battle action decision unit 166, a win/lose determination unit 167, and a storage unit 170. The game progression control unit 160 has an operation interpreting unit 161 and a display control unit 162.

The operation interpreting unit 161 is configured to interpret operations made by the player on the display screen that is displayed on the touch panel 110 by the display control unit 162. The game progression control unit 160 is configured to perform overall control of the game provided in the terminal 100A, based on the player operations interpreted by the operation interpreting unit 161. The game progression control unit 160 is configured to generate internal parameters having the same content as the game parameters in the above-mentioned embodiment. The display control unit 162 is configured to generate display screens based on the game parameters generated by the game progression control unit 160. The display control unit 162 is configured to display the display screens on the touch panel 110. Because the screens displayed by the terminal 100A on the touch panel 110 are the same as in the above-mentioned embodiment, the screens will not be illustrated again.

The slot game lottery unit 165 is configured to perform a lottery regarding the slot game executed within the game, and to decide the stop positions of the slot reels. In some cases, the slot game lottery unit 165 may be configured to decide the reel stop positions by random number processing or the like so that the slot reels stop when a certain amount of time has elapsed from the point in time when the player operates the spin switch. In other cases, the slot game lottery unit 165 may be configured to decide the reel stop positions so that the slot reels stop when a certain amount of time has elapsed from the point in time when the player operates the spin switch. The battle action decision unit 166 may be configured to decide the battle action of the player character and the battle action of the enemy character, in accordance with the processing results of the slot game lottery unit 165. The win/lose determination unit 167 may be configured to calculate the damage, amount of reduction of hit points, to each character, in accordance with the battle action of the player character and the battle action of the enemy character. The win/lose determination unit 167 may be configured to determine the winner, based on the remaining hit points. The processing of these functional units is the same as the processing by the slot game lottery unit 40, the battle action decision unit 50, and the win/lose determination unit 60 of the above-mentioned embodiments.

The storage unit 170 stores data such as background image data and elemental image data such as image data for characters, symbols on the slot game reels, display parameters, and items and the like for various modes, data indicating the game progression, reel symbol arrangement information, a table of correspondence between slot game lottery results and battle actions, character parameters, and data of obtained items.

Figure 23:
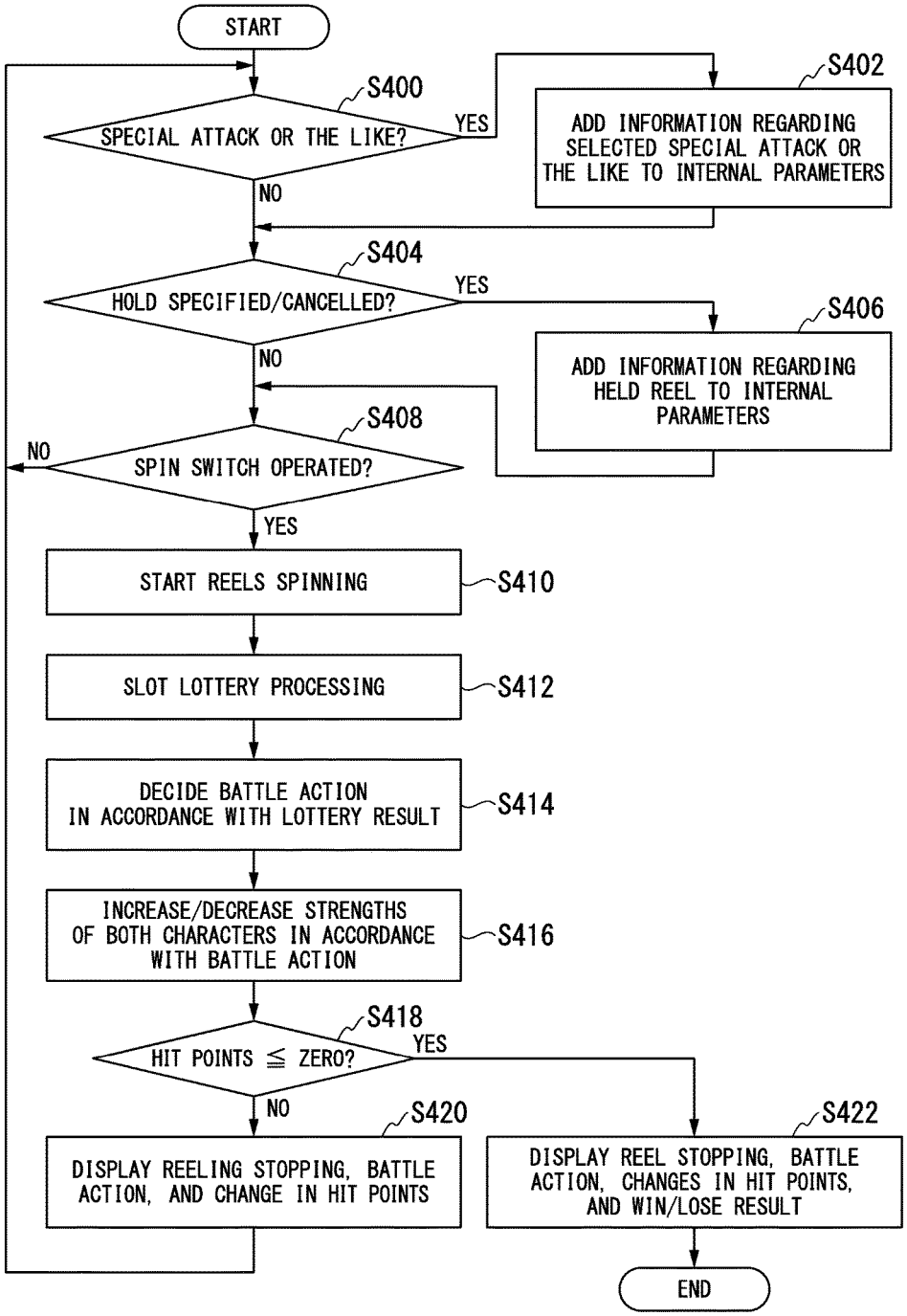
FIG. 23 is a flow chart of processes to be processed by the terminal of FIG. 22.

FIG. 23 shows an example of a flowchart showing the flow of processing executed by the terminal 100A, which functions as a stand-alone game. First, the operation interpreting unit 161 judges whether the player has selected a special attack, a magical attack, a defense, a recovery, or another battle action (step S400). If the player has selected a special attack or the like, the operation interpreting unit 161 adds information regarding the selected special attack or the like to the internal parameters (step S402). When the player has cancelled the specification of a special attack or the like, the operation interpreting unit 161 deletes the information regarding the specified special attack or the like, although this is not illustrated.

Next, the operation interpreting unit 161 of the terminal 100A judges whether or not the player has specified or cancelled a reel to be held (step S404). If the player has specified or released a reel to be held, information regarding the slot reels to be ultimately held is added to the internal parameters (step S406).

Next, the operation interpreting unit 161 of the terminal 100A judges whether or not the player has operated the spin switch (step S408). When the play operates the spin switch, the display control unit 162 of the terminal 100A displays on the touch panel 110 an image of the reel groups B1 and C1 that have started spinning (step S410). The operation interpreting unit 161 of the terminal 100A repeats execution of steps S400 to S408 during the time in which the player is operating the spin switch.

Next, the slot game lottery unit 165 of the terminal 100A performs slot game lottery processing (step S412). The slot game lottery unit 165 decides the stop positions of the slot reels of the reel group B1 that are to spin and each of the slot reels of the reel group C1, by random number processing or the like.

The battle action decision unit 166 of the terminal 100A references the lottery results (stop positions of each reel) of the slot game lottery unit 165 and decides a battle action associated with the symbols that stop S300 on the hit line HL as the battle action of player character (step S414). The battle action decision unit 166 also decides the enemy character battle action, in accordance with the symbols that stop at a prescribed position in the reel group C1, in the example of FIG. 10, the position of display on the screen.

When the battle actions are decided, the win/lose determination unit 167 increases or decreases hit points of the characters, in accordance with the existence or non-existence of a battle action or a special attack or the like by both the characters (step S416). Specifically, in accordance with a battle action of the player character, the win/lose determination unit 167 decreases hit points of the enemy character and increases the defensive strength of the player character, and causes the player character to recover hit points. In accordance with the battle action of the enemy character, the win/lose determination unit 167 performs processing such as processing to reduce hit points of the player character.

Then, as a result of the processing of step S416, the win/lose determination unit 167 determines whether or not hit points of one of the characters is zero or below to determine which wins and lose in the battle game (step S418). If hit points of at both characters is greater than zero, the display control unit 162 of the terminal 100A stops the spinning of the reel groups B1 and C1 as decided by the slot game lottery unit 165. The display control unit 162 displays a screen corresponding to a battle action. The display control unit 162 reflects on the screen the change in the parameters such as hit points (step S420). However, if hit points of one of the characters is zero or below, the display control unit 162 stops the spinning of the reel groups B1 and C1 at positions decided by the slot game lottery unit 165. The display control unit 162 displays a screen corresponding to a battle action. The display control unit 162 reflects on the screen the change in the parameters such as hit points. The display control unit 162 displays the win/lose outcome (step S422). If the battle has not yet ended, the game progression control unit 160 of the terminal 100A returns to step S400, but if the battle has ended, the processing of the flowchart of FIG. 23 is ended.

In the above configuration, the terminal 100A configured to function as a stand-alone game device, will provide to the player a game that is the same as described in the above-mentioned embodiments. The terminal 100A makes it possible to broaden the scope of battle action that the character executes, and to build game excitement.

[Hardware Configuration]

The game server 1 and the terminal 100 and 100A in the above-described embodiments have a computer system which encompasses hardware such as a CPU (central processing unit), a memory device such as RAM or the like, a storage device such as a ROM, a hard-disk drive, or a flash memory, a drive apparatus for a removable storage medium, and peripheral devices and the like.

A computer-readable recording medium can be used to store, in the form of a program the operating processes of the various units and serves such as the game progression control unit 30, the slot game lottery unit 40, the battle action decision unit 50, and the win/lose determination unit 60 of the game server 1, and the operation information generation unit 140, the terminal display control unit 150 of the terminal 100, as well as the game progression control unit 160, the operation interpreting unit 161, the display control unit 162, the slot game lottery unit 165, the battle action decision unit 166, and the win/lose determination unit 167. The above-mentioned processing can be performed by a computer system when reading and executing this program. Rather than all of the processing of each functional part being performed by execution of the program, a part of the functional parts may be implemented by hardware such as an IC (integrated circuit), and an LSI (large-scale integration) device.

In some aspects of the invention, a game device may include, but is not limited to, a lottery unit, a decision unit, and a determination unit. The lottery unit may be configured to decide stop positions of spinning slot reels of a first reel group displayed on a display. The decision unit may be configured to select a type of battle action among plural types of battle action, with reference to the stop positions of the spinning slot reels of the first reel group decided by the lottery unit. The decision unit may be configured to decide the selected type of battle action as a battle action by a player character. Each type of battle action has an attribution associated with a set of symbols of the slot reels at the stop positions. The plural types of battle action include a first type of battle action having a first attribution to attack an enemy character and a second type of battle action having a second attribution different from the first attribution. The determination unit may be configured to decrease hit points of the enemy character in response to battle action by the player character, and to decrease hit points of the player character in response to battle action by the enemy character. The determination unit may be configured to determine a winner based on respective remaining amounts of the hit points of the player character and the enemy character.

In some cases, the game device may be configured by plural computing devices such as terminals and a server computer, which are operatively coupled to each other via any available connection such as any available network. In some cases, the game device may be configured by a single computing device such as a terminal. The terminal may be any game device which is configured to be dedicated to a game machine or a communication terminal which is configured to communicate through any network to a server computer and which is not dedicated as a gaming device. In those configurations mentioned above, each computer, a terminal or a server computer may be implemented by a storage storing a computer readable program and a processor to execute the program to perform the functions and/or operations of the lottery unit, the decision unit, and the determination unit.

Typical examples of the lottery unit may be, but are not limited to, the slot game lottery unit 40 and the slot game lottery unit 165 described in the illustrative embodiments. Typical examples of the decision unit may be, but are not limited to, the battle action decision unit 50 and the battle action decision unit 166 described in the illustrative embodiments. Typical examples of the determination unit may be, but are not limited to, the win/lose determination unit 60 and the win/lose determination unit 167 described in the illustrative embodiments.

In some cases, the second type of battle action having the second attribution may include at least one of a battle action to recover hit points of the player character and a battle action to increase a defensive strength of the player character against a battle action by the enemy character.

In some cases, the lottery unit may be configured to decide stop positions of spinning slot reels of the first reel group associated with the player character, and to decide stop positions of spinning slot reels of a second reel group associated with the enemy character. The decision unit may be configured to decide a type of battle action, having an attribution associated with a set of symbols at the stop positions of spinning slot reels of the first reel group, as a battle action by the player character. The decision unit may be configured to decide a type of battle action, having an attribution associated with a set of symbols at the stop positions of spinning slot reels of the second reel group, as a battle action by the enemy character. Typical examples of the lottery unit may be, but are not limited to, the slot game lottery unit 40 and the slot game lottery unit 165 described in the illustrative embodiments. Typical examples of the decision unit may be, but are not limited to, the battle action decision unit 50 and the battle action decision unit 166 described in the illustrative embodiments.

In some cases, the game device may further include, but is not limited to, a display control unit. The display control unit may be configured to display, on the display, images that slot reels of the first and second reel groups start to spin simultaneously. The display control unit may be configured to display, on the display, images that slot reels of the first and second reel groups stop spinning simultaneously. Typical examples of the display control unit may be, but are not limited to, the terminal display control unit 150 and the display control unit 162 described in the illustrative embodiments.

In some cases, the lottery unit may be configured to stop the spinning of at least one slot reel of the first reel group. The lottery unit may be configured to decide stop positions of the one or more remaining slot reels of the first reel group while the at least one slot reel of the first reel group has stopped from spinning. Typical examples of the lottery unit may be, but are not limited to, the slot game lottery unit 40 and the slot game lottery unit 165 described in the illustrative embodiments.

In some cases, as described above, the second type of battle action having the second attribution may include at least one of a battle action to recover hit points of the player character and a battle action to increase a defensive strength of the player character against a battle action by the enemy character. In this case, the lottery unit may be configured to stop the spinning of at least one slot reel of the first reel group. The lottery unit may be configured to decide stop positions of the one or more remaining slot reels of the first reel group while the at least one slot reel of the first reel group has stopped from spinning. Typical examples of the lottery unit may be, but are not limited to, the slot game lottery unit 40 and the slot game lottery unit 165 described in the illustrative embodiments.

In some cases, as described above, the lottery unit may be configured to decide stop positions of spinning slot reels of the first reel group associated with the player character, and to decide stop positions of spinning slot reels of a second reel group associated with the enemy character. The decision unit may be configured to decide a type of battle action, having an attribution associated with a set of symbols at the stop positions of spinning slot reels of the first reel group, as a battle action by the player character. The decision unit may be configured to decide a type of battle action, having an attribution associated with a set of symbols at the stop positions of spinning slot reels of the second reel group, as a battle action by the enemy character. In this case, the lottery unit may be configured to stop the spinning of at least one slot reel of the first reel group. The lottery unit may be configured to decide stop positions of the one or more remaining slot reels of the first reel group while the at least one slot reel of the first reel group has stopped from spinning. Typical examples of the lottery unit may be, but are not limited to, the slot game lottery unit 40 and the slot game lottery unit 165 described in the illustrative embodiments. Typical examples of the decision unit may be, but are not limited to, the battle action decision unit 50 and the battle action decision unit 166 described in the illustrative embodiments.

In some cases, the lottery unit may be configured to stop the spinning of at least one slot reel of the first reel group. The lottery unit may be configured to decide stop positions of the one or more remaining slot reels of the first reel group while the at least one slot reel of the first reel group has stopped from spinning. In this case, the lottery unit may be configured to hold symbol-matched slot reels of the first reel group from spinning in a next spinning, where the symbol-matched slot reels have the same symbol on a hold line at the stop positions. Typical examples of the lottery unit may be, but are not limited to, the slot game lottery unit 40 and the slot game lottery unit 165 described in the illustrative embodiments.

In some cases, the lottery unit may be configured to stop at least one player-designated slot reel of the first reel group from spinning in accordance with a designation by a player. The lottery unit may be configured to decide stop positions of the one or more remaining slot reels of the first reel group while the at least one player-designated slot reel of the first reel group has stopped from spinning. Typical examples of the lottery unit may be, but are not limited to, the slot game lottery unit 40 and the slot game lottery unit 165 described in the illustrative embodiments.

In some cases, the second type of battle action having the second attribution may include at least one of a battle action to recover hit points of the player character and a battle action to increase a defensive strength of the player character against a battle action by the enemy character. In this case, the lottery unit may be configured to stop at least one player-designated slot reel of the first reel group from spinning in accordance with a designation by a player. The lottery unit may be configured to decide stop positions of the one or more remaining slot reels of the first reel group while the at least one player-designated slot reel of the first reel group has stopped from spinning. Typical examples of the lottery unit may be, but are not limited to, the slot game lottery unit 40 and the slot game lottery unit 165 described in the illustrative embodiments.

In some cases, the lottery unit may be configured to decide stop positions of spinning slot reels of the first reel group associated with the player character, and to decide stop positions of spinning slot reels of a second reel group associated with the enemy character. The decision unit may be configured to decide a type of battle action, having an attribution associated with a set of symbols at the stop positions of spinning slot reels of the first reel group, as a battle action by the player character. The decision unit may be configured to decide a type of battle action, having an attribution associated with a set of symbols at the stop positions of spinning slot reels of the second reel group, as a battle action by the enemy character. In this case, the lottery unit may be configured to stop at least one player-designated slot reel of the first reel group from spinning in accordance with a designation by a player, and configured to decide stop positions of the one or more remaining slot reels of the first reel group while the at least one player-designated slot reel of the first reel group has stopped from spinning. Typical examples of the lottery unit may be, but are not limited to, the slot game lottery unit 40 and the slot game lottery unit 165 described in the illustrative embodiments.

In some cases, the lottery unit may be configured to stop at least one player-designated slot reel of the first reel group from spinning in accordance with a designation by a player. The lottery unit may be configured to decide stop positions of the one or more remaining slot reels of the first reel group while the at least one player-designated slot reel of the first reel group has stopped from spinning. In this case, the lottery unit may be configured to hold symbol-matched slot reels of the first reel group from spinning in a next spinning, where the symbol-matched slot reels have the same symbol on a hold line at the stop positions. Typical examples of the lottery unit may be, but are not limited to, the slot game lottery unit 40 and the slot game lottery unit 165 described in the illustrative embodiments.

In some cases, the decision unit may be configured to accumulate parameter values associated with the symbols at the stop positions each time the spinning of the slot reels are stopped. The decision unit may be configured to recognize whether an accumulated total value of the parameter values exceeds a reference value. The decision unit may be configured to select a different type of battle action when the decision unit recognizes the accumulated total value exceeds the reference value, the different type of battle is different from any available types of battle action which are selectable by the decision unit when the accumulated total value does not exceed the reference value. Typical examples of the decision unit may be, but are not limited to, the battle action decision unit 50 and the battle action decision unit 166 described in the illustrative embodiments.

In some cases, the second type of battle action having the second attribution may include at least one of a battle action to recover hit points of the player character and a battle action to increase a defensing this case, the decision unit may be configured to accumulate parameter values associated with the symbols at the stop positions each time the spinning of the slot reels are stopped. The decision unit may be configured to recognize whether an accumulated total value of the parameter values exceeds a reference value. The decision unit may be configured to select a different type of battle action when the decision unit recognizes the accumulated total value exceeds the reference value, where the different type of battle is different from any available types of battle action which are selectable by the decision unit when the accumulated total value does not exceed the reference value. Typical examples of the decision unit may be, but are not limited to, the battle action decision unit 50 and the battle action decision unit 166 described in the illustrative embodiments.

In some cases, the lottery unit may be configured to decide stop positions of spinning slot reels of the first reel group associated with the player character, and to decide stop positions of spinning slot reels of a second reel group associated with the enemy character. The decision unit may be configured to decide a type of battle action, having an attribution associated with a set of symbols at the stop positions of spinning slot reels of the first reel group, as a battle action by the player character. The decision unit may be configured to decide a type of battle action, having an attribution associated with a set of symbols at the stop positions of spinning slot reels of the second reel group, as a battle action by the enemy character. In this case, the decision unit may be configured to accumulate parameter values associated with the symbols at the stop positions each time the spinning of the slot reels are stopped. The decision unit may be configured to recognize whether an accumulated total value of the parameter values exceeds a reference value. The decision unit may be configured to select a different type of battle action when the decision unit recognizes the accumulated total value exceeds the reference value, where the different type of battle is different from any available types of battle action which are selectable by the decision unit when the accumulated total value does not exceed the reference value. Typical examples of the lottery unit may be, but are not limited to, the slot game lottery unit 40 and the slot game lottery unit 165 described in the illustrative embodiments. Typical examples of the decision unit may be, but are not limited to, the battle action decision unit 50 and the battle action decision unit 166 described in the illustrative embodiments.

In some cases, as described above, the second type of battle action having the second attribution may include at least one of a battle action to recover hit points of the player character and a battle action to increase a defensive strength of the player character against a battle action by the enemy character. In this case, the lottery unit may be configured to stop the spinning of at least one slot reel of the first reel group. The lottery unit may be configured to decide stop positions of the one or more remaining slot reels of the first reel group while the at least one slot reel of the first reel group has stopped from spinning. The decision unit may be configured to accumulate parameter values associated with the symbols at the stop positions each time the spinning of the slot reels are stopped. The decision unit may be configured to recognize whether an accumulated total value of the parameter values exceeds a reference value. The decision unit may be configured to select a different type of battle action when the decision unit recognizes the accumulated total value exceeds the reference value, where the different type of battle is different from any available types of battle action which are selectable by the decision unit when the accumulated total value does not exceed the reference value. Typical examples of the lottery unit may be, but are not limited to, the slot game lottery unit 40 and the slot game lottery unit 165 described in the illustrative embodiments. Typical examples of the decision unit may be, but are not limited to, the battle action decision unit 50 and the battle action decision unit 166 described in the illustrative embodiments.

In some cases, the lottery unit may be configured to stop at least one player-designated slot reel of the first reel group from spinning in accordance with a designation by a player. The lottery unit may be configured to decide stop positions of the one or more remaining slot reels of the first reel group while the at least one player-designated slot reel of the first reel group has stopped from spinning. The decision unit may be configured to accumulate parameter values associated with the symbols at the stop positions each time the spinning of the slot reels are stopped. The decision unit may be configured to recognize whether an accumulated total value of the parameter values exceeds a reference value. The decision unit may be configured to select a different type of battle action when the decision unit recognizes the accumulated total value exceeds the reference value, where the different type of battle is different from any available types of battle action which are selectable by the decision unit when the accumulated total value does not exceed the reference value. Typical examples of the lottery unit may be, but are not limited to, the slot game lottery unit 40 and the slot game lottery unit 165 described in the illustrative embodiments. Typical examples of the decision unit may be, but are not limited to, the battle action decision unit 50 and the battle action decision unit 166 described in the illustrative embodiments.

In other aspects of the invention, a computer-implemented game control method may include, but is not limited to the following processes. A process is made to decide stop positions of spinning slot reels of a first reel group displayed on a display. A process is made to select a type of battle action among plural types of battle action, with reference to the stop positions of the spinning slot reels of the first reel group decided, so as to decide the selected type of battle action as a battle action by a player character, where each type of battle action has an attribution associated with a set of symbols of the slot reels at the stop positions, and where the plural types of battle action include a first type of battle action having a first attribution to attack an enemy character and a second type of battle action having a second attribution different from the first attribution. A process is made to decrease hit points of the enemy character in response to battle action by the player character. A process is made to decrease hit points of the player character in response to battle action by the enemy character. A process is made to determine a winner based on respective remaining amounts of the hit points of the player character and the enemy character.

In some cases, the game control method may be performed by plural computing devices such as terminal and a server computer, which are operatively coupled to each other via any available connection such as any available network. In some cases, the game control method may be performed by a single computing device such as a terminal. The terminal may be any game device which is configured to be dedicated to a game machine or a communication terminal which is configured to communicate through any network to a server computer and which is not dedicated as a gaming device. In those configurations mentioned above, each computer, a terminal or a server computer may be implemented by a storage storing a computer readable program and a processor to execute the program to perform the game control method.

A typical example of the process to decide the stop positions of spinning slot reels may be, but is not limited to, the process of step S300, described in the illustrative embodiments, in which the slot game lottery unit 40 of the game server 1 performs slot game lottery processing to decide the stop positions of the slot reels of the reel group that are to spin and of each of the slot reels of the reel group, by random number processing or the like. Another typical example of the process to decide the stop positions of spinning slot reels may be, but is not limited to, the process of step S412, described in the illustrative embodiments, in which the slot game lottery unit 165 of the terminal 100A performs slot game lottery processing, and the slot game lottery unit 165 decides the stop positions of the slot reels of the reel group that are to spin and each of the slot reels of the reel group, by random number processing or the like.

A typical example of the process to select a type of battle action among plural types of battle action, with reference to the stop positions of the spinning slot reels of the first reel group decided, so as to decide the selected type of battle action as a battle action by a player character, may be, but is not limited to, the process of step S302, described in the illustrative embodiments, in which the battle action decision unit 50 of the game server 1 references the lottery results, stop positions of each reel, by the slot game lottery unit 40 and decides a battle action as the battle action of the player character that is associated with the symbols that have stopped along the hit line HL. Another typical example of the process to select a type of battle action among plural types of battle action, with reference to the stop positions of the spinning slot reels of the first reel group decided, so as to decide the selected type of battle action as a battle action by a player character, may be, but is not limited to, the process of step S414, described in the illustrative embodiments, in which the battle action decision unit 166 of the terminal 100A references the lottery results (stop positions of each reel) of the slot game lottery unit 165 and decides a battle action associated with the symbols that stop on the hit line HL as the battle action of player character.

A typical example of the process to decrease hit points of the enemy character in response to battle action by the player character and also to decrease hit points of the player character in response to battle action by the enemy character may be, but is not limited to, the process of step S304, described in the illustrative embodiments, in which the win/lose determination unit 60 increases or decreases hit points of the characters, in accordance with the presence or absence of a battle action or a special attack by both characters. In accordance with a battle action of the player character, the win/lose determination unit 60 decreases hit points of the enemy character. The win/lose determination unit 60 also performs processing such as processing to reduce hit points of the player character, in accordance with the battle action of the enemy character. Another typical example of the process to decrease hit points of the enemy character in response to battle action by the player character and also to decrease hit points of the player character in response to battle action by the enemy character may be, but is not limited to, the process of step S416, described in the illustrative embodiments, in which the win/lose determination unit 167 increases or decreases hit points of the characters, in accordance with the existence or non-existence of a battle action or a special attack or the like by both characters.

A typical example of the process to determine a winner based on respective remaining amounts of the hit points of the player character and the enemy character may be, but is not limited to, the process of step S306, described in the illustrative embodiments, in which the win/lose determination unit 60 determines whether or not hit points of one of the characters is zero or below to determine which wins and lose in the battle game. Another typical example of the process to determine a winner based on respective remaining amounts of the hit points of the player character and the enemy character may be, but is not limited to, the process of step S418, described in the illustrative embodiments, in which the win/lose determination unit 167 determines whether or not hit points of one of the characters is zero or below to determine which wins and lose in the battle game.

In other aspects of the invention, a non-transitory computer readable medium that stores a computer program to be executed by a computer to perform a game control method. The method may include, but is not limited to the following processes. A process is made to decide stop positions of spinning slot reels of a first reel group displayed on a display. A process is made to select a type of battle action among plural types of battle action, with reference to the stop positions of the spinning slot reels of the first reel group decided, so as to decide the selected type of battle action as a battle action by a player character, where each type of battle action has an attribution associated with a set of symbols of the slot reels at the stop positions, and where the plural types of battle action include a first type of battle action having a first attribution to attack an enemy character and a second type of battle action having a second attribution different from the first attribution. A process is made to decrease hit points of the enemy character in response to battle action by the player character. A process is made to decrease hit points of the player character in response to battle action by the enemy character. A process is made to determine a winner based on respective remaining amounts of the hit points of the player character and the enemy character.

In some cases, the game control method may be performed by plural computing devices such as terminals and a server computer, which are operatively coupled to each other via any available connection such as any available network. In some cases, the game control method may be performed by a single computing device such as a terminal. The terminal may be any game device which is configured to be dedicated to a game machine or a communication terminal which is configured to communicate through any network to a server computer and which is not dedicated as a gaming device. In those configurations mentioned above, each computer, a terminal or a server computer may be implemented by a storage storing a computer readable program and a processor to execute the program to perform the game control method.

A typical example of the process to decide the stop positions of spinning slot reels may be, but is not limited to, the process of step S300, described in the illustrative embodiments, in which the slot game lottery unit 40 of the game server 1 performs slot game lottery processing to decide the stop positions of the slot reels of the reel group that are to spin and of each of the slot reels of the reel group, by random number processing or the like. Another typical example of the process to decide the stop positions of spinning slot reels may be, but is not limited to, the process of step S412, described in the illustrative embodiments, in which the slot game lottery unit 165 of the terminal 100A performs slot game lottery processing, and the slot game lottery unit 165 decides the stop positions of the slot reels of the reel group that are to spin and each of the slot reels of the reel group, by random number processing or the like.

A typical example of the process to select a type of battle action among plural types of battle action, with reference to the stop positions of the spinning slot reels of the first reel group decided, so as to decide the selected type of battle action as a battle action by a player character, may be, but is not limited to, the process of step S302, described in the illustrative embodiments, in which the battle action decision unit 50 of the game server 1 references the lottery results, stop positions of each reel, by the slot game lottery unit 40 and decides a battle action as the battle action of the player character that is associated with the symbols that have stopped along the hit line HL. Another typical example of the process to select a type of battle action among plural types of battle action, with reference to the stop positions of the spinning slot reels of the first reel group decided, so as to decide the selected type of battle action as a battle action by a player character, may be, but is not limited to, the process of step S414, described in the illustrative embodiments, in which the battle action decision unit 166 of the terminal 100A references the lottery results (stop positions of each reel) of the slot game lottery unit 165 and decides a battle action associated with the symbols that stop on the hit line HL as the battle action of player character.

A typical example of the process to decrease hit points of the enemy character in response to battle action by the player character and also to decrease hit points of the player character in response to battle action by the enemy character may be, but is not limited to, the process of step S304, described in the illustrative embodiments, in which the win/lose determination unit 60 increases or decreases hit points of the characters, in accordance with the presence or absence of a battle action or a special attack by both characters. In accordance with a battle action of the player character, the win/lose determination unit 60 decreases hit points of the enemy character. The win/lose determination unit 60 also performs processing such as processing to reduce hit points of the player character, in accordance with the battle action of the enemy character. Another typical example of the process to decrease hit points of the enemy character in response to battle action by the player character and also to decrease hit points of the player character in response to battle action by the enemy character may be, but is not limited to, the process of step S416, described in the illustrative embodiments, in which the win/lose determination unit 167 increases or decreases hit points of the characters, in accordance with the existence or non-existence of a battle action or a special attack or the like by both characters.

A typical example of the process to determine a winner based on respective remaining amounts of the hit points of the player character and the enemy character may be, but is not limited to, the process of step S306, described in the illustrative embodiments, in which the win/lose determination unit 60 determines whether or not hit points of one of the characters is zero or below to determine which wins and lose in the battle game. Another typical example of the process to determine a winner based on respective remaining amounts of the hit points of the player character and the enemy character may be, but is not limited to, the process of step S418, described in the illustrative embodiments, in which the win/lose determination unit 167 determines whether or not hit points of one of the characters is zero or below to determine which wins and lose in the battle game.

The term "computer readable recording medium" as used herein refers to any non-transitory tangible medium. Typical examples of the computer readable recording medium may include, but are not limited to, a removable medium such as a flexible disc, an optical disk, an optomagnetic disk, a ROM, a CD-ROM, or the like, or a storage device such as a hard disk drive or the like that is built into a computer system. Typical examples of the computer readable recording medium may also include one that dynamically holds a program for a given period of time, such as various devices included in a communication system that transmits a program via a network such as the Internet or by a communication circuit such as a telephone line, and also a device that holds a program for a certain time, such as a volatile memory of a computer system that functions as a server or client in that case.

The above-mentioned program may implement a part of the above-described functions, and further may implement the above-described functions in combination with a program already stored in a computer system.

The term "configured" is used to describe a component, section or part of a device includes hardware alone or in combination with software that is constructed and/or programmed to carry out the desired function.

It is apparent that the present invention is not limited to the above embodiments, but may be modified and changed without departing from the scope and spirit of the invention.

What is claimed is:

1. A game device comprising:

a display screen;

at least one storage device that comprises at least one memory;

at least one software component stored in the at least one memory; and at least one processor, when reading and executing the at least one software component, configured to at least:

a) control progression of a game having at least a non-battle mode and a battle mode in which a player character of a player battles an enemy character;

b) decide stop positions of spinning slot reels of a first reel group in the battle mode;

c) select a type of battle action among plural types of battle action of the game in the battle mode, with reference to the stop positions of the spinning slot reels of the first reel group decided, each of the plural types of battle action having an attribution associated with a set of symbols of the slot reels of the first reel group at the stop positions, the plural types of battle action including a first type of battle action having a first attribution to attack the enemy character and a second type of battle action having a second attribution different from the first attribution;

d) decide the selected type of battle action as a battle action by the player character in the battle mode;

e) decrease hit points of the enemy character in response to the battle action by the player character in the battle mode;

f) decrease hit points of the player character in response to a battle action by the enemy character in the battle mode;

g) determine a winner based on respective remaining amounts of the hit points of the player character and the enemy character in the battle mode;

h) accumulate parameter values associated with the symbols at the stop positions each time the spinning of the slot reels are stopped in the battle mode;

i) recognize whether an accumulated total value of the parameter values exceeds a reference value in the battle mode;

j) select a different type of battle action when the accumulated total value exceeds the reference value in the battle mode, wherein the different type of battle action is different from any available types of battle action which are selectable when the accumulated total value does not exceed the reference value;

k) display, in a first display mode, a non-battle image of the game in the non-battle mode on the display screen without displaying the slot reels on the display screen, wherein the non-battle image does not depict a picture of the enemy character;

l) display, in a second display mode on the display screen, the slot reels together with a battle image of the selected type of battle action simultaneously in the battle mode on the display screen, without displaying the non-battle image of the game in the battle mode in the first display mode on the display screen;

m) display, in a third display mode on the display screen, a plurality of group symbols indicating a plurality of player groups to allow the player to select a group symbol from the plurality of group symbols to designate a player group, indicated by the selected symbol, to which the player will belong;

n) generate an operation information that indicates the group of which group symbol the player selected;

o) update a status of the game progression based on the operation information;

p) display, in a fourth display mode on the display screen, a plurality of play region symbols indicating a plurality of play regions to allow the player to select a play region symbol from the plurality of play region symbols to designate a play region, indicated by the selected play region symbol, in which the player will play; and q) in response to having selected a play region symbol, display, in the first display mode on the display screen, the non-battle image.

2. The game device according to claim 1, wherein the second type of battle action having the second attribution includes at least one of a battle action to recover hit points of the player character and a battle action to increase a defensive strength of the player character against a battle action by the enemy character.

3. The game device according to claim 2, wherein the at least one processor is, when reading and executing the at least one software component:

configured to stop the spinning of at least one slot reel of the first reel group, and configured to decide stop positions of the one or more remaining slot reels of the first reel group while the at least one slot reel of the first reel group has stopped from spinning.

4. The game device according to claim 2, wherein the at least one processor is, when reading and executing the one or more software component:

configured to: stop at least one player-designated slot reel of the first reel group from spinning in accordance with a designation by the player, and configured to decide stop positions of the one or more remaining slot reels of the first reel group while the at least one player-designated slot reel of the first reel group has stopped from spinning.

5. The game device according to claim 1, wherein the at least one processor is, when reading and executing the at least one software component, configured:

to decide stop positions of the spinning slot reels of the first reel group associated with the player character, and to decide stop positions of the spinning slot reels of a second reel group associated with the enemy character, wherein the at least one processor is, when reading and executing the at least one software component, configured to decide a type of battle action, having an attribution associated with a set of symbols at the stop positions of the spinning slot reels of the first reel group, as a battle action by the player character, and wherein the at least one processor is, when reading and executing the at least one software component, configured to decide a type of battle action, having an attribution associated with a set of symbols at the stop positions of the spinning slot reels of the second reel group, as a battle action by the enemy character.

6. The game device according to claim 5, further comprising:

a display controller configured to control the display screen, on the display screen, images that the slot reels of the first and second reel groups start to spin simultaneously.

7. The game device according to claim 5, further comprising:

a display controller configured to control the display, on the display screen, images that the slot reels of the first and second reel groups stop spinning simultaneously.

8. The game device according to claim 5, wherein the at least one processor is, when reading and executing the at least one software component:

configured to stop the spinning of at least one slot reel of the first reel group, and configured to decide stop positions of the one or more remaining slot reels of the first reel group while the at least one slot reel of the first reel group has stopped from spinning.

9. The game device according to claim 5, wherein the at least one processor is, when reading and executing the at least one software component:

configured to: stop at least one player-designated slot reel of the first reel group from spinning in accordance with a designation by a player, and configured to decide stop positions of the one or more remaining slot reels of the first reel group while the at least one player-designated slot reel of the first reel group has stopped from spinning.

10. The game device according to claim 1, wherein the at least one processor is, when reading and executing the at least one software component, configured to: stop the spinning of at least one slot reel of the first reel group, and configured to decide stop positions of the one or more remaining slot reels of the first reel group while the at least one slot reel of the first reel group has stopped from spinning.

11. The game device according to claim 10, wherein the at least one processor is, when reading and executing the at least one software component, configured to: hold symbol-matched slot reels of the first reel group from spinning in a next spinning, the symbol-matched slot reels have the same symbol on a line at the stop positions.

12. The game device according to claim 1, wherein the at least one processor is, when reading and executing the at least one software component:

configured to: stop at least one player-designated slot reel of the first reel group from spinning in accordance with a designation by a player, and configured to decide stop positions of the one or more remaining slot reels of the first reel group while the at least one player-designated slot reel of the first reel group has stopped from spinning.

13. The game device according to claim 12, wherein the at least one processor is, when reading and executing the at least one software component, configured to hold symbol-matched slot reels of the first reel group from spinning in a next spinning, the symbol-matched slot reels have the same symbol on a line at the stop positions.

14. A computer-implemented game control method comprising:

a) controlling progression of a game having at least a non-battle mode and a battle mode in which a player character of a player battles an enemy character;

b) deciding stop positions of spinning slot reels of a first reel group in the battle mode;

c) selecting a type of battle action among plural types of battle action of the game in the battle mode, with reference to the stop positions of the spinning slot reels of the first reel group decided, each of the plural types of battle action having an attribution associated with a set of symbols of the slot reels at the stop positions, the plural types of battle action including a first type of battle action having a first attribution to attack the enemy character and a second type of battle action having a second attribution different from the first attribution;

d) deciding the selected type of battle action as a battle action by the player character in the battle mode;

e) decreasing hit points of the enemy character in response to the battle action by the player character in the battle mode;

f) decreasing hit points of the player character in response to a battle action by the enemy character in the battle mode;

g) determining a winner based on respective remaining amounts of the hit points of the player character and the enemy character in the battle mode;

h) accumulating parameter values associated with the symbols at the stop positions each time the spinning of the slot reels are stopped in the battle mode;

i) recognizing whether an accumulated total value of the parameter values exceeds a reference value in the battle mode;

j) selecting a different type of battle action when the accumulated total value exceeds the reference value in the battle mode, wherein the different type of battle action is different from any available types of battle action which are selectable when the accumulated total value does not exceed the reference value;

k) displaying, in a first display mode, a non-battle image of the game in the non-battle mode on the display screen without displaying the slot reels on the display screen, wherein the non-battle image does not depict a picture of the enemy character;

l) displaying, in a second display mode on the display screen, slot reels together with a battle image of the selected type of battle action simultaneously in the battle mode on the display screen, without displaying the non-battle image of the game in the battle mode in the first display mode on the display screen;

m) displaying, in a third display mode on the display screen, a plurality of group symbols indicating a plurality of player groups to allow the player to select a group symbol from the plurality of group symbols to designate a player group, indicated by the selected symbol, to which the player will belong;

n) generating an operation information that indicates the group of which group symbol the player selected;

o) updating a status of the game progression based on the operation information;

p) displaying, in a fourth display mode on the display screen, a plurality of play region symbols indicating a plurality of play regions to allow the player to select a play region symbol from the plurality of play region symbols to designate a play region, indicated by the selected play region symbol, in which the player will play; and q) in response to having selected a play region symbol, displaying, in the first display mode on the display screen, the non-battle image.

15. A non-transitory computer readable medium that stores a computer program to be executed by a computer to perform a game control method, the method comprising:

a) controlling progression of a game having at least a non-battle mode and a battle mode in which a player character of a player battles an enemy character;

b) deciding stop positions of spinning slot reels of a first reel group in the battle mode;

c) selecting a type of battle action among plural types of battle action of the game in the battle mode, with reference to the stop positions of the spinning slot reels of the first reel group decided, each of the plural types of battle action having an attribution associated with a set of symbols of the slot reels at the stop positions, the plural types of battle action including a first type of battle action having a first attribution to attack an enemy character and a second type of battle action having a second attribution different from the first attribution;

d) deciding the selected type of battle action as a battle action by the player character in the battle mode;

e) decreasing hit points of the enemy character in response to the battle action by the player character in the battle mode;

f) decreasing hit points of the player character in response to a battle action by the enemy character in the battle mode;

g) determining a winner based on respective remaining amounts of the hit points of the player character and the enemy character in the battle mode;

h) accumulating parameter values associated with the symbols at the stop positions each time the spinning of the slot reels are stopped in the battle mode;

i) recognizing whether an accumulated total value of the parameter values exceeds a reference value in the battle mode;

j) selecting a different type of battle action when the accumulated total value exceeds the reference value in the battle mode, wherein the different type of battle action is different from any available types of battle action which are selectable when the accumulated total value does not exceed the reference value;

k) displaying, in a first display mode, a non-battle image of the game in the non-battle mode on the display screen without displaying the slot reels on the display screen, wherein the non-battle image does not depict a picture of the enemy character;

l) displaying, in a second display mode on the display screen, the slot reels together with a battle image of the selected type of battle action simultaneously in the battle mode on the display screen, without displaying the non-battle image of the game in the battle mode in the first display mode on the display screen;

m) displaying, in a third display mode on the display screen, a plurality of group symbols indicating a plurality of player groups to allow the player to select a group symbol from the plurality of group symbols to designate a player group, indicated by the selected symbol, to which the player will belong;

n) generating an operation information that indicates the group of which group symbol the player selected;

o) updating a status of the game progression based on the operation information;

p) displaying, in a fourth display mode on the display screen, a plurality of play region symbols indicating a plurality of play regions to allow the player to select a play region symbol from the plurality of play region symbols to designate a play region, indicated by the selected play region symbol, in which the player will play; and q) in response to having selected a play region symbol, displaying, in the first display mode on the display screen, the non-battle image.

* * * * *